US008309237B2

(12) United States Patent
Levendusky et al.

(10) Patent No.: US 8,309,237 B2
(45) **Date of Patent: *Nov. 13, 2012**

(54) CORROSION RESISTANT ALUMINUM ALLOY SUBSTRATES AND METHODS OF PRODUCING THE SAME

(75) Inventors: Thomas L. Levendusky, Greensburg, PA (US); Albert L. Askin, Lower Burrell, PA (US); Joseph D. Guthrie, Murrysville, PA (US); Luis Fanor Vega, Cheswick, PA (US); Kevin M. Robare, New Kinsington, PA (US); Clinton Zediak, Tarentum, PA (US); Wilson C. Lee, Sterling Heighs, MI (US); Jaskirat Sohi, Beechwood, OH (US)

(73) Assignee: Alcoa Inc., Pittsburgh, PA (US)

( * ) Notice: Subject to any disclaimer, the term of this patent is extended or adjusted under 35 U.S.C. 154(b) by 219 days.

This patent is subject to a terminal disclaimer.

(21) Appl. No.: 12/197,097

(22) Filed: Aug. 22, 2008

(65) Prior Publication Data

US 2009/0061218 A1 Mar. 5, 2009

Related U.S. Application Data

(63) Continuation-in-part of application No. 11/846,483, filed on Aug. 28, 2007, now Pat. No. 7,732,068.

(51) Int. Cl.

| | |
|---|---|
| ***B32B 15/04*** | (2006.01) |
| ***B32B 5/18*** | (2006.01) |
| ***C25D 11/08*** | (2006.01) |
| ***C25D 11/18*** | (2006.01) |

(52) U.S. Cl. ..... 428/704; 428/336; 428/472.2; 428/335; 428/304.4; 148/265; 148/256; 205/201; 205/213; 205/229

(58) Field of Classification Search ..... None
See application file for complete search history.

(56) References Cited

U.S. PATENT DOCUMENTS

| | | | | |
|---|---|---|---|---|
| 2,729,551 | A | 1/1956 | Cohn | 41/42 |
| 2,941,930 | A | 6/1960 | Mostovych et al. | 204/29 |
| 3,530,048 | A | 9/1970 | Darrow | 204/33 |
| 4,229,266 | A | 10/1980 | Usbeck | 205/201 |
| 4,585,670 | A | 4/1986 | Liu | 427/515 |
| 4,737,246 | A | 4/1988 | Powers et al. | 204/58 |
| 4,874,837 | A | 10/1989 | Bershas et al. | |
| 5,326,803 | A | 7/1994 | Avakian et al. | |
| 5,484,751 | A * | 1/1996 | Colombier et al. | 501/87 |
| 6,099,899 | A | 8/2000 | Briggs et al. | |

(Continued)

FOREIGN PATENT DOCUMENTS

| | | |
|---|---|---|
| DE | 957616 | 8/1956 |

(Continued)

OTHER PUBLICATIONS

International Patent Application Serial No. PCT/US08/74074, International Search Report and Written Opinion (mailed Sep. 22, 2009).

(Continued)

*Primary Examiner* — Jennifer McNeil
*Assistant Examiner* — Vera Katz
(74) *Attorney, Agent, or Firm* — Greenberg Traurig LLP

(57) ABSTRACT

Aluminum alloy products comprising an aluminum alloy base and a sulfate-phosphate oxide zone integral therewith are disclosed. Methods of making the same are also disclosed.

16 Claims, 16 Drawing Sheets

U.S. PATENT DOCUMENTS

| | | | | |
|---|---|---|---|---|
| 6,200,684 | B1 | 3/2001 | Yamaguchi et al. | 428/447 |
| 6,228,241 | B1 | 5/2001 | Alwitt et al. | |
| 6,242,054 | B1 | 6/2001 | Baalmann et al. | 427/489 |
| 6,277,917 | B1 | 8/2001 | Jurgetz et al. | |
| 6,309,427 | B1 | 10/2001 | Korte | |
| 6,316,057 | B1 | 11/2001 | Hirayama et al. | 427/400 |
| 6,329,487 | B1 | 12/2001 | Abel et al. | 528/21 |
| 6,440,290 | B1 | 8/2002 | Vega et al. | 205/201 |
| 6,528,672 | B2 | 3/2003 | Yamaguchi et al. | 556/419 |
| 6,534,184 | B2 | 3/2003 | Knasiak et al. | 428/447 |
| 6,560,845 | B2 | 5/2003 | Serafin et al. | 29/469.5 |
| 6,627,559 | B2 | 9/2003 | Shindo | 438/780 |
| 6,652,978 | B2 | 11/2003 | Lukacs, III et al. | 428/450 |
| 6,696,143 | B1 | 2/2004 | La Point | |
| 6,756,469 | B2 | 6/2004 | Lukacs, III | 528/93 |
| 6,776,834 | B2 | 8/2004 | Sirejacob | 106/287.1 |
| 6,866,945 | B2 * | 3/2005 | Kuo et al. | 428/650 |
| 6,887,367 | B2 | 5/2005 | Berg et al. | 205/220 |
| 7,122,599 | B2 | 10/2006 | Haubennestel et al. | 525/100 |
| 7,148,360 | B2 | 12/2006 | Flynn et al. | 548/264.6 |
| 7,211,329 | B2 | 5/2007 | Metz et al | 428/446 |
| 7,645,488 | B2 | 1/2010 | Hotz et al. | |
| 7,732,068 | B2 | 6/2010 | Levendusky et al. | |
| 2002/0049274 | A1 | 4/2002 | Azechi et al. | 524/440 |
| 2002/0146568 | A1 | 10/2002 | Ho et al. | |
| 2003/0164113 | A1 | 9/2003 | Suzuki | 106/18.32 |
| 2004/0047997 | A1 | 3/2004 | Keller et al. | 427/402 |
| 2004/0062783 | A1 | 4/2004 | De Sloovere et al. | 424/409 |
| 2004/0067247 | A1 | 4/2004 | De Sloovere et al. | 424/409 |
| 2004/0131652 | A1 | 7/2004 | Shindo | 424/423 |
| 2004/0192835 | A1 | 9/2004 | Steidl et al. | 524/591 |
| 2004/0214015 | A1 | 10/2004 | Asai et al. | 428/429 |
| 2005/0119402 | A1 | 6/2005 | Suzuki et al. | 524/588 |
| 2005/0121644 | A1 | 6/2005 | Dams et al. | 252/8.62 |
| 2005/0279255 | A1 | 12/2005 | Suzuki et al. | 106/287.11 |
| 2006/0057190 | A1 | 3/2006 | Henn | 424/443 |
| 2006/0115657 | A1 | 6/2006 | Griswold | 428/447 |
| 2006/0194707 | A1 | 8/2006 | Lu | 510/245 |
| 2006/0204767 | A1 | 9/2006 | Albert et al. | 428/447 |
| 2007/0026237 | A1 | 2/2007 | Dang et al. | 428/421 |
| 2007/0029207 | A1 | 2/2007 | Anglin et al. | 205/300 |
| 2007/0054056 | A1 | 3/2007 | Albert et al. | 427/387 |
| 2007/0092739 | A1 | 4/2007 | Steele et al. | 428/450 |
| 2007/0106008 | A1 | 5/2007 | Onoue et al. | 524/493 |
| 2007/0116968 | A1 | 5/2007 | Dierdorf et al. | 428/446 |
| 2009/0061216 | A1 | 3/2009 | Levendusky | 428/336 |
| 2009/0162544 | A1 | 6/2009 | Garesche et al. | |
| 2009/0220806 | A1 | 9/2009 | Dierdorf et al. | |

FOREIGN PATENT DOCUMENTS

| | | |
|---|---|---|
| DE | 102005051755 | 5/2007 |
| GB | 2421959 | 7/2006 |
| JP | 06-299393 | 10/1994 |
| WO | 9103583 | 3/1991 |
| WO | 2005066258 | 7/2005 |
| WO | WO 2005/066258 | 7/2005 |
| WO | 20061027007 | 3/2006 |
| WO | 2006074085 | 7/2006 |
| WO | WO 2006/074085 | 7/2006 |
| WO | 2007048513 | 5/2007 |
| WO | WO 2007/048513 | 5/2007 |
| WO | 2007121091 | 10/2007 |
| WO | 2007121102 | 10/2007 |
| WO | 2007121108 | 10/2007 |
| WO | WO 2007/121091 | 10/2007 |
| WO | WO 2007/121102 | 10/2007 |
| WO | WO 2007/121108 | 10/2007 |
| WO | 2008051789 | 5/2008 |
| WO | WO 2008/051789 | 5/2008 |
| WO | 2008154279 | 12/2008 |
| WO | WO 2008/154279 | 12/2008 |
| WO | WO 2009/032567 | 3/2009 |

OTHER PUBLICATIONS

U.S. Appl. No. 11/846,483, entitled "Corrosion Resistant Aluminum Alloy Substrates and Methods of Producing the Same," Non-Final Office Action (mailed Aug. 6, 2009).

Related U.S. Appl. No. 11/846,483, entitled "Corrosion Resistant Aluminum Alloy Substrates and Methods of Producing the Same," Final Office Action (mailed Apr. 10, 2009).

"International Alloy Designations and Chemical Composition Limits for Wrought Aluminum and Wrought Aluminum Alloys," Registration Record Series Teal Sheets, The Aluminum Association, Inc., www.aluminum.org, Apr. 2006, pp. 1-32.

Bach, T., "Take off for a new technology," pp. 1-18, 3M Deutschland GmBH, Energy and Advanced Materials Division, 2009.

Raju, et al., "Fatigue Life Assessment of Aluminum Alloy Wheels Under Bending Loads," *International Journal of Material Science*, vol. 3, No. 2, pp. 211-222, (2008).

Moore, R. R., "Rotating Beam Fatigue Testing System," Instron web site www.instron.com, 2007.

Wernick, S. et al., "Electrolytic and Chemical Polishing," in *The Surface Treatment and Finishing of Aluminium and its Alloys*, Ch. 3, pp. 112-129 (1972).

Wernick, S. et al., "Electrolytic and Chemical Polishing Processes," in *The Surface Treatment and Finishing of Aluminium and its Alloys*, Ch. 3, pp. 74-154 (1964).

Wernick, S. et al., "Chemical Conversion Coatings," in *The Surface Treatment and Finishing of Aluminium and its Alloys*, Ch. 5, pp. 194-202, 224-232, 236-247 (1964).

Wernick, S. et al., "Anodizing of Aluminium: General Notes and Theory," in *The Surface Treatment and Finishing of Aluminium and its Alloys*, Ch. 6, pp. 248-271, 279-286, 294-297 (1964).

Wernick, S. et al., "Decorative and Protective Anodizing," in *The Surface Treatment and Finishing of Aluminium and its Alloys*, Ch. 7, pp. 298-308,331-349, 366-388 (1964).

Wernick, S. et al., "Hard Anodizing," in *The Surface Treatment and Finishing of Aluminium and its Alloys*, Ch. 9, pp. 404-416, 437-439 (1964).

Wernick, S. et al., "Physical and Chemical Properties of Anodic Oxide Coatings," in *The Surface Treatment and Finishing of Aluminium and its Alloys*, Ch. 12, pp. 510-512, 524, 535-553, 577-580 (1964).

"Aluminum Association Designation System for Aluminum Finishes," pp. 1-3, downloaded from the Internet on Dec. 3, 2010 at http://www.anodizing.org/Publications/bulletin_1.html.

"Cleaning, Finishing, and Coating," in *ASM Specialty Handbook: Aluminum and Aluminum Alloys*, pp. 451-482, ASM International (1993).

*Ex Parte Artemi*, Decision on Appeal, mailed Aug. 10, 2010, in U.S. Appl. No. 11/397,053, Patent No. 5,584,455, Appeal No. 2010-007831, Reexamination Control No. 90/006,286.

"Wrought Products" in *ASM Specialty Handbook: Aluminum and Aluminum Alloys*, pp. 59-87, ASM International (1993).

"Material Safety Data Sheet," pp. 1-8, 3M Surface Project 1000 (SP-1000), Oct. 21, 2009.

"Military Specification: Anodic Coatings for Aluminum and Aluminum Alloys," Pub. No. MIL-1-8625F, Amendment 1 (Sep. 15, 2003).

US Office Action dated Jul. 13, 2011 from U.S. Appl. No. 12/766,733.

Australian Office Action dated Jul. 7, 2011 from corresponding Australian application No. 20088296633.

Bach, Thomas, "Take off for a new technology," 3M Deutschland GmBH, Energy and Advanced Materials Division, 2009.

"Material Safety Data Sheet", 3M Surface Project 1000 (SP-1000), Oct. 21, 2009.

U.S. Appl. No. 11/846,483, entitled "Corrosion Resistant Aluminum Alloy Substrates and Methods of Producing the Same", Final Office Action (mailed Dec. 30, 2009).

Moore, R.R., "Rotating Beam Fatigue Testing System," Instron web site www.instron.com, 2007.

Wernick, S. et al., "Electrolytic and Chemical Polishing," in The Surface Treatment and Finishing of Aluminum and its Alloys, Ch. 3, pp. 112-129 (1972).

Wernick, S. et al, "Electrolytic and Chemical Polishing Processes," in The Surface Treatment and Finishing of Aluminum and its Alloys, Ch. 3, pp. 74-154 (1964).

Wernick, S. et al. "Chemical Conversion Coatings," in The Surface Treatment and Finishing of Aluminum and its Alloys, Ch. 5, pp. 194-202, 224-232, 236-237 (1964).

Wernick S. et al. "Anodizing of Aluminum: General Notes and Theory," in The Surface Treatment and Finishing of Aluminum and its Alloys, Ch. 6, pp. 248-271, 279-286, 294-297 (1964).
Wernick S. et al. "Decorative and Protective Anodizing," in The Surface Treatment and Finishing of Aluminum and its Alloys, Ch. 7, pp. 298-308, 331-349, 366-388 (1964).
Wernick S. et al. "Hard Anodizing," in The Surface Treatment and Finishing of Aluminum and its Alloys, Ch. 9, pp. 404-416, 437-439 (1964).
Wernick S. al. et al "Physical and Chemical Properties of Anodic Oxide Coatings," in The Surface Treatment and Finishing of Aluminum and its Alloys, Ch. 12, pp. 510-512, 524, 535-553, 577-580 (1964).
"Aluminum Association Designation System for Aluminum Finishes," pp. 1-3, downloaded from the internet on Dec. 3, 2010 at http://www.anodizing.org/Publicatins/bulletin_1.html.
Ex Parte Artemi, Decision on Appeal, mailed Aug. 10, 2010, in U.S. Appl. No. 11/397,053, Patent No. 5,584,455, Appeal No. 2010-007831, Reexamination Control No. 09/006,286.
Office Action, dated Dec. 20, 2010, from commonly-owned European Application No. 08798527.1.
Non-Final Office Action dated Mar. 21, 2011, from U.S. Appl. No. 11/961,560.
Tajima, S., Adv. Corr. Sci. Technology, vol. 1, pp. 227-362, (1970).
Wernick et al., *Surface Treatment of Aluminum*, 4th Ed., vol. 1, pp. 297-300, (1972).
Wernick et al., *Surface Treatment of Aluminum*, 4th Ed., vol. 2, pp. 500-503, (1972).
*Aluminum Anodizing*, http://vvww.docmachine.com/tech/anod.html.
*Sol-Gel Technology*, http://www.chemat.com/html/solgel.html.
*Anodize Systems: side-arm, split rail, overhead hoist, for Type I Chromic Acid Anodize, Type II Sulfuric Acid Anodize, Type III Hardcoat, PAA, BSAA*, http://www.walgren.com/anodizing-systems.html.
Nov. 10, 2008 Office Action from related U.S. Appl. No. 11/846,483.

* cited by examiner

QUALITATIVE RESULTS FOR CENTER OXIDE SPECTRUM
ANALYSIS: PEAK METHOD:MANUAL
ACQUIRED 30.0 KeV @ 10 eV/CHANNEL

| PEAK (KeV) | ELEMENT | INTENSITIES | ROI (GROSS) |
|---|---|---|---|
| 0.528 | O Ka1 | 0.0 | 4975.88 |
| 1.494 | Al Ka1 | 66898.5 | 69020.56 |
| 1.751 | Si Ka1 | 12850.9 | 13527.81 |
| 2.027 | P Ka1 | 682.8 | 1113.28 |
| 2.314 | S Ka1 | 8106.9 | 8999.62 |

CORROSION RESISTANT ALUMINUM ALLOY SUBSTRATES AND METHODS OF PRODUCING THE SAME

CROSS REFERENCE TO RELATED APPLICATIONS

This application is a continuation-in-part of U.S. patent application Ser. No. 11/846,483, filed Aug. 28, 2007, now U.S. Pat. No. 7,732,068 B2,entitled "CORROSION RESISTANT ALUMINUM ALLOY SUBSTRATES AND METHODS OF PRODUCING THE SAME", which is incorporated herein by reference in its entirety. This application is also related to PCT patent application No. PCT/US2008/074074, filed Aug. 22, 2008, and entitled "CORROSION RESISTANT ALUMINUM ALLOY SUBSTRATES AND METHODS OF PRODUCING THE SAME", which is incorporated herein by reference in its entirety.

BACKGROUND

Many metallic substrates, such as those including aluminum alloys, may be anodized to increase corrosion resistance and wear resistance of the substrate. Anodizing is an electrolytic passivation process used to increase the thickness and density of the natural oxide layer on the surface of metal parts. Anodic films can also be used for a number of cosmetic effects, either via thick porous coatings that can absorb dyes or via thin transparent coatings that add interference effects to reflected light. Anodic films are generally much stronger and more adherent than most paints and platings, making them less likely to crack and peel. Anodic films are most commonly applied to protect aluminum alloys, although processes also exist for titanium, zinc, magnesium, and niobium.

With respect to aluminum alloys, during anodizing an aluminum oxide coating is grown from and into the surface of the aluminum alloy in about equal amounts, so, for example, a 2 μm thick coating will increase part dimensions by 1 μm per surface. Anodized aluminum alloy surfaces can also be dyed. In most consumer goods the dye is contained in the pores of the aluminum oxide layer. Anodized aluminum surfaces have low to moderate wear resistance, although this can be improved with thickness and sealing. If wear and scratches are minor then the remaining oxide will continue to provide corrosion protection even if the dyed layer is removed.

While conventional anodizing processes may yield anodized substrates having good abrasion resistance and ability to color the surface with dyes, such substrates are not without their drawbacks. For instances, many anodized substrates are unable to provide durability and chemical stability in a corrosive environment, and also are generally unable to provide hydration stability in humid and outdoor environments. Protective compounds may be applied to the anodized surfaces, but it is difficult to maintain adhesion and chemical compatibility of these protective compounds with anodized surfaces while maintaining suitable abrasion resistance and coloring ability. In turn, the overall performance of the corresponding finished products may be inadequate for certain applications.

SUMMARY OF THE INVENTION

Broadly, the instant application relates to aluminum alloys having sulfate-phosphate oxide zones included therein, wear and/or corrosion resistant aluminum alloy products produced from the same, and methods of producing the same. The sulfate-phosphate oxide zones of the aluminum alloys may promote increased adhesion between the aluminum alloy and polymers coated thereon. In turn, corrosion resistant substrates may be produced. The corrosion resistant substrates may be wear resistant, visually appealing (e.g., glossy) and have a relatively smooth outer surface (e.g., have a low coefficient of friction). In turn, the corrosion resistant aluminum alloy substrates may have "slicker" surfaces, and thus reduced material accumulation may be realized on the surface.

In one aspect, aluminum alloy products are provided. In one embodiment, an aluminum alloy product includes an aluminum alloy base and a sulfate-phosphate oxide zone integral with the base. In one embodiment, the aluminum alloy product is a forged product. In one embodiment, the aluminum alloy product is a wheel product.

The aluminum alloy base may be any suitable aluminum alloy, but in some instance is a wrought aluminum alloy, such as any of the 2XXX, 3XXX, 5XXX, 6XXX, 7XXX series alloys, or a cast aluminum alloy of the A3XX series, as defined by The Aluminum Association, Inc. In one embodiment, the aluminum alloy is a 6061 series alloy. In one embodiment, the aluminum alloy base 10 is a 2014 series alloy. In one embodiment, the aluminum alloy base 10 is a 7050 series alloy. In one embodiment, the aluminum alloy base 10 is a 7085 series alloy.

The features of the sulfate-phosphate oxide zone may be tailored. In one embodiment, the sulfate-phosphate oxide zone comprises pores. The pores may facilitate, for example, flow of polymer therein. In one embodiment, the pores have an average pore size of at least about 10 nm. In one embodiment, the pores have an average pore size of not greater than about 15 nm. In one embodiment, the sulfate-phosphate oxide zone has a thickness of at least about 0.0002 inch (about 5 microns). In one embodiment, the sulfate-phosphate oxide zone has a thickness of not greater than about 0.001 inch (25 microns).

The aluminum alloy product may include a polymer zone. In one embodiment, the polymer zone at least partially overlaps with the sulfate-phosphate oxide zone. In one embodiment, the polymer zone includes a silicon-based polymer. In one embodiment, the silicon-based polymer is polysiloxane. In one embodiment, the silicon-based polymer is polysilazane. The interface and/or adhesion between the polymer zone and the sulfate-phosphate oxide zone may be facilitated via the pores or the sulfate-phosphate oxide zone.

In one embodiment, the polymer zone includes a coating portion on a surface of the aluminum alloy base. In one embodiment, the coating has a thickness of at least about 5 microns. In one embodiment, the coating has a thickness of at least about 8 microns. In one embodiment, the coating has a thickness of at least about 35 microns. In one embodiment, the coating is substantially crack-free (e.g., as determined visually and/or via optical microscopy). In one embodiment, the coating is adherent to a surface of the aluminum alloy base. In one embodiment, all or nearly all of the coating passes the Scotch 610 tape pull test, as defined by ASTM D3359-02, Aug. 10, 2002. In one embodiment, all or nearly all of the coating passes the Scotch 610 tape pull test after army-navy humidity testing of 1000 hours, as defined by ASTM D2247-02, Aug. 10, 2002. In one embodiment, the aluminum-alloy base, the sulfate-phosphate oxide zone, and the polymer zone define a corrosion resistant aluminum alloy substrate. In one embodiment, the corrosion resistant substrate is capable of passing a copper-accelerated acetic acid salt spray test (CASS), as defined by ASTM B368-97(2003) e1.

In another aspect, methods of producing substrates having a sulfate-phosphate oxide zone are provided. In one embodiment, a method includes producing a sulfate-phosphate oxide zone in an aluminum alloy base and forming a polymer zone integral with at least a portion of the sulfate-phosphate oxide zone. In one embodiment, the producing the sulfate-phosphate oxide zone step comprises electrochemically oxidizing a surface of the aluminum alloy base via an electrolyte comprising both phosphoric acid and sulfuric acid. In one embodiment, the electrolyte comprises at least about 0.1 wt % phosphoric acid. In one embodiment, the electrolyte comprises not greater than about 5 wt % phosphoric acid.

In one embodiment, the electrochemically oxidizing step comprises applying current to the aluminum alloy base at a current density of at least about 12 amps per square foot (1.11 amps per square meter). In one embodiment, the electrochemically oxidizing step comprises applying current to the aluminum alloy base at a current density of at least about 18 amps per square foot (1.67 amps per square meter). In one embodiment, the electrochemically oxidizing step comprising heating the electrolyte to a temperature of at least about 75° F. (about 23.9° C.). In one embodiment, the electrochemically oxidizing step comprising heating the electrolyte to a temperature of at least about 90° F. (about 32.2° C.).

In one embodiment, the polymer zone is a silicon-containing polymer zone. In one embodiment, silicon-containing polymer zone comprises at least one of polysiloxane and polysilazane. In one embodiment, the forming the polymer zone step includes depositing a colloid on at least a portion of the sulfate-phosphate oxide zone, and curing the colloid to form a gel comprising the silicon-containing polymer coating on the surface of the aluminum alloy base. In one embodiment, the colloid is a sol. In one embodiment, the depositing step includes applying a sufficient amount of the sol to both: (a) fill pores of the sulfate-phosphate oxide zone, and (b) form a coating comprising the silicon-containing polymer coating.

In one embodiment, the method includes pretreating a surface of the aluminum alloy base with a pretreating agent before the producing the sulfate-phosphate oxide zone step. In one embodiment, the pretreating agent comprises a chemical brightening composition that includes at least one of nitric acid, phosphoric acid and sulfuric acid. In one embodiment, the pretreating agent comprises an alkaline cleaner. In one embodiment, the method includes applying at least one of a dye and a nickel acetate solution to at least a portion of the sulfate-phosphate oxide zone before the forming a polymer zone step.

The instant disclosure also relates to anodized aluminum alloy products having improved fatigue characteristics. Typically, anodizing of aluminum product (e.g., wheels) results in a surface oxide that provides protection and hardness to the wheel surface. In some instances, one of the desired performance criteria of anodized aluminum products is to exhibit no loss in fatigue performance relative to a non-anodized product of similar composition, form and temper. Fatigue is a phenomenon in which crack initiation and crack propagation occur when a structure is subjected to repeated loading stresses. Upon exposure to sufficient number of cycles, cracking could start in the structure, and even when the applied stress in the structure would be below the ultimate tensile strength or the tensile yield strength of the structure. To test fatigue of a material, various industrial standard tests may be utilized. With respect to aluminum alloy wheel products, test modes can include rotary fatigue and radial fatigue testing (e.g., in accordance with SAE J328, a North America industrial standard for wheel fatigue testing). Rotary fatigue tests represent the loading a wheel experiences in a cornering event. Radial fatigue tests represent the loading on the wheel in straight road conditions. These fatigue tests may be run for a set number of cycles and the wheels need to meet specified performance criteria to be considered acceptable. There are standard fatigue test requirements from original equipment manufacturers (OEMs).

Conventional Type II anodized wheels, with an oxide thickness range of 12-17 microns, have a fatigue life that is at least 75% lower than the fatigue life of non-anodized wheels of the same composition, shape, and temper. It is generally recognized that this amount of fatigue life reduction is unacceptable from a commercial perspective. To overcome this drawback, the wheel is over-designed which results in heavier mass thus negatively impacting gas mileage and vehicle performance.

In one approach, a wrought aluminum alloy product having improved fatigue performance is provided. In one embodiment, the wrought aluminum alloy product comprises an aluminum alloy base, a sulfate-phosphate oxide zone integral with the base, the sulfate-phosphate oxide zone having an average thickness of at least about 8 microns, and a silicon-containing polymer zone at least partially overlapping the sulfate-phosphate oxide zone, wherein the silicon-containing polymer zone comprises a coating portion on a surface of the aluminum alloy base. This mixed-electrolyte anodized aluminum alloy product has a fatigue life that is better than the fatigue life of a Type-II anodized aluminum alloy product of similar composition, shape, and temper and having a similar oxide thickness. Unless otherwise indicated, the comparison of the fatigue lives of the aluminum alloy products is completed via rotating beam samples tested in accordance with ASTM E466-07, entitled "Standard Practice for Conducting Force Controlled Constant Amplitude Axial Fatigue Tests of Metallic Materials." In one embodiment, the wrought aluminum alloy product has a fatigue life that is better than the fatigue life of a Type-II anodized and sodium dichromate sealed aluminum alloy product of similar composition, shape and temper and having a similar oxide thickness.

In one embodiment, the fatigue life of the mixed electrolyte wrought aluminum alloy product is at least about 5% better, than the fatigue life of a Type-II anodized aluminum alloy product of similar composition, shape and temper and having a similar oxide thickness. In other embodiments, the fatigue life of the mixed electrolyte wrought aluminum alloy product is at least about 25% better, or 50% better, or 100% better, or 200% better than the fatigue life of a Type-II anodized aluminum alloy product of similar composition, shape and temper and having a similar oxide thickness.

In one embodiment, the fatigue resistant aluminum alloy product is a forged aluminum alloy product. In one embodiment, the forged aluminum alloy product is an aluminum alloy wheel product. In one embodiment, the aluminum alloy wheel product comprises at least one of a 2XXX and 6XXX series aluminum alloy. In one embodiment, the aluminum alloy wheel product has a cornering fatigue life that is better than the cornering fatigue life of a Type-II anodized aluminum alloy wheel product of similar composition, shape and temper and having a similar oxide thickness. In one embodiment, the aluminum alloy wheel product has a radial fatigue life that is better than the radial fatigue life of a Type-II anodized aluminum alloy wheel product of similar composition, shape and temper and having a similar oxide thickness. In other embodiments, the fatigue resistant aluminum alloy product is a sheet or plate product. In other embodiments, the aluminum alloy product is an extrusion product. The cornering fatigue life or radial fatigue life may be tested in accordance with SAE J328, SAE J267, Japanese Industrial Standard (JIS) D 4103, and/or ISO: 7141-1981, as appropriate.

As may be appreciated, various ones of the inventive aspects noted hereinabove may be combined to yield various aluminum alloy products having improved adhesive, corrosion and/or appearance qualities, to name a few. Moreover, these and other aspects, advantages, and novel features of the invention are set forth in part in the description that follows and will become apparent to those skilled in the art upon examination of the following description and figures, or may be learned by practicing the invention.

DETAILED DESCRIPTION

Figure 1:
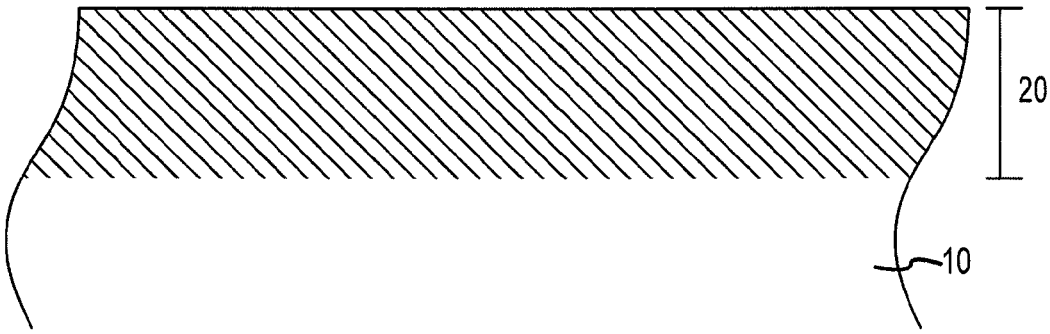
FIG. 1 is a schematic, cross-sectional view of one embodiment of an aluminum alloy base including a sulfate-phosphate oxide zone.

Reference is now made to the accompanying drawings, which at least assist in illustrating various pertinent features of the instant application. In one approach, the instant application relates to aluminum alloys having a sulfate-phosphate oxide zone. One embodiment of an aluminum alloy having a sulfate-phosphate oxide zone is illustrated in FIG. 1. In the illustrated embodiment, an aluminum alloy base 10 includes a sulfate-phosphate oxide zone 20. In general, and as described in further detail below, the aluminum alloy base 10 may be modified with a mixed electrolyte (e.g., sulfuric acid plus phosphoric acid) to produce the sulfate-phosphate oxide zone 20. The sulfate-phosphate oxide zone 20 may promote, among other things, adhesion of the polymers to the aluminum alloy base 10, as described in further detail below.

The aluminum alloy base 10 may be any material adapted to have a sulfate-phosphate oxide zone formed therein via electrochemical processes. As used herein, "aluminum alloy" means a material including aluminum and another metal alloyed therewith, and includes one or more of the Aluminum Association 2XXX, 3XXX, 5XXX, 6XXX and 7XXX series alloys. The aluminum alloy base 10 may be from any of a forging, extrusion, casting or rolling manufacturing process. In one embodiment, the aluminum alloy base 10 comprises a 6061 series alloy. In one embodiment, the aluminum alloy base 10 comprises a 6061 series alloy with a T6 temper. In one embodiment, the aluminum alloy base 10 comprises a 2014 series alloy. In one embodiment, the aluminum alloy base 10 comprises a 7050 series alloy. In one embodiment, the aluminum alloy base 10 comprises a 7085 series alloy. In one embodiment, the aluminum alloy base 10 is a wheel product (e.g., a rim). In one embodiment, the aluminum alloy base 10 is a building product (e.g., aluminum siding or composite panel).

In the illustrated embodiment, the aluminum alloy base 10 includes a sulfate-phosphate oxide zone 20. As used herein, "sulfate-phosphate oxide zone" means a zone produced from electrochemical oxidation of the aluminum alloy base 10, and which zone may include elemental aluminum (Al), sulfur (S), phosphorus (P) and/or oxygen (O) and compounds thereof. In one embodiment, and as described in further detail below, the sulfate-phosphate oxide zone 20 may be produced from an electrolyte comprising both sulfuric acid and phosphoric acid.

The sulfate-phosphate oxide zone 20 generally comprises an amorphous morphology that includes a plurality of sulfate-phosphate pores (not illustrated). As used herein, "sulfate-phosphate oxide pores" means pores of the sulfate-phosphate oxide zone 20 that include elemental Al, O, S and/or P or compounds thereof and proximal a surface thereof. As described in further detail below, such sulfate-phosphate oxide pores may facilitate increased adhesion between polymers and the sulfate-phosphate oxide zone 20 via chemical interaction between the polymer and one or more of the Al, O, S, and P elements located on a surface thereof or proximal thereto.

The sulfate-phosphate oxide zone 20 may include an amorphous and porous morphology, which may facilitate increased adhesion between polymer and the aluminum alloy via an increased surface area. Conventionally anodized surfaces generally include columnar morphology (e.g., for a Type II, sulfuric acid only anodized surface), or a nodal morphology (e.g., for a phosphoric acid only anodized surface). Conversely, the porous, amorphous morphology of the sulfate-phosphate oxide zone 20 generally comprises a high surface area relative to such conventionally anodized surfaces. This higher surface area may contribute to increased adhesion between polymer coatings and the aluminum alloy base 10.

Increased adhesion of polymers to the aluminum alloy base 10 may be realized by tailoring the pore size of the sulfate-phosphate oxide pores. For example, the pore size of the sulfate-phosphate oxide pores may be tailored so as to facilitate flow of certain polymers therein by creating sulfate-phosphate oxide pores having an average pore size that is coincidental to the radius of gyration of the polymer to be used to coat the aluminum alloy base 10. In one embodiment, the average pore size of the sulfate-phosphate oxide pores may be in the range of from about 10 nm to about 15 nanometers, and the polymer may be a silicon-containing polymer, such as polysilazane and polysiloxane polymers. Since this average pore size range is coincidental to the radius of gyration of such polymers, these polymers (or their precursors) may readily flow into the sulfate-phosphate oxide pores. In turn, the polymers may readily bond with the sulfate-phosphate oxides associated therewith (e.g., during curing of the polymer, described in further detail below).

As used herein, "average pore size" means the average diameters of the sulfate-phosphate oxide pores of the sulfate-phosphate oxide zone as measured using microscopic techniques. As used herein, "radius of gyration" means the mean size of the polymer molecules of a sample over time, and may be calculated using an average location of monomers over time or ensemble:

$$R_g^2 \stackrel{def}{=} \frac{1}{N}\left\langle \sum_{k=1}^{N} (r_k - r_{mean})^2 \right\rangle$$

where the angular brackets ⟨ . . . ⟩ denote the ensemble average.

To promote chemical interaction between surfaces of the sulfate-phosphate oxide zone and the polymer, the ratio of sulfur atoms to phosphorus atoms may be tailored. In one embodiment, the polymer is a silicon-based polymer and the ratio of sulfur atoms to phosphorus in the sulfate-phosphate oxide zone 20 is at least about 5:1 (S:P), such as at least about 10:1 (S:P), or even at least about 20:1 (S:P). In this embodiment, the ratio sulfur atoms to phosphorus atoms in the sulfate-phosphate oxide zone 20 may not exceed about 100:1 (S:P), or even not greater than about 75:1 (S:P).

The thickness of the sulfate-phosphate oxide zone 20 may be tailored so as to produce a zone having sufficient surface area for bonding with a polymer. In this regard, the sulfate-phosphate oxide zone 20 of the corrosion resistant substrate 1 generally has a thickness of at least about 5 microns (0.00020 inch), such as a thickness of at least about 6 microns (0.00024 inch). The sulfate-phosphate oxide zone generally has a thickness of not greater than about 25 microns (about 0.001 inch), such as not greater than about 17 microns (about 0.00065 inch).

Figure 2:
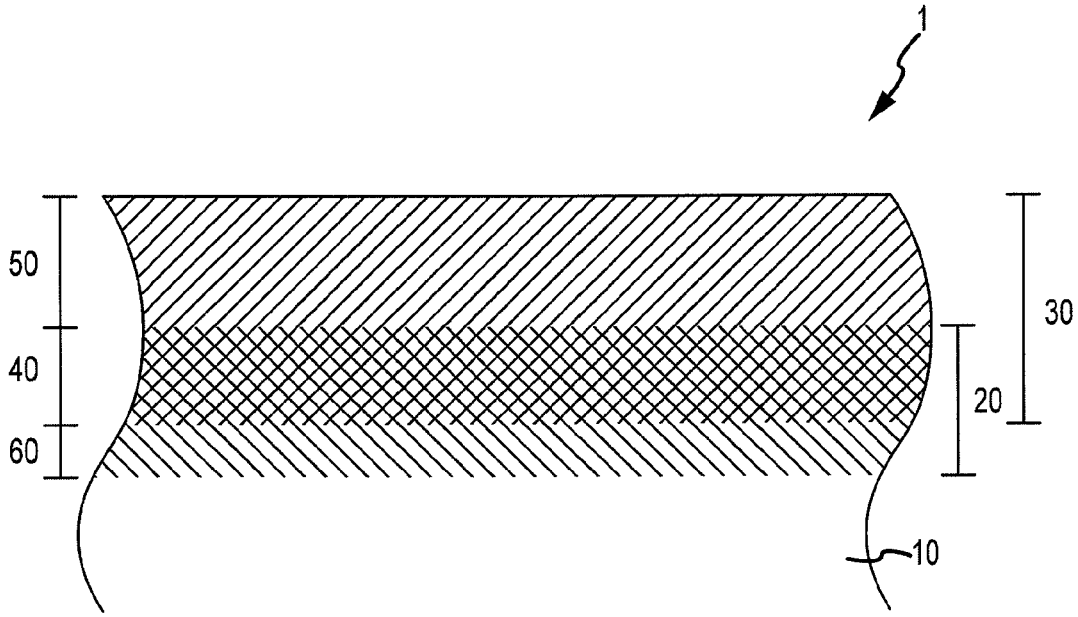
FIG. 2 is a schematic, cross-sectional view of one embodiment of a corrosion resistant substrate.

As noted above, aluminum alloys include sulfate-phosphate oxides may be utilized to produce wear/corrosion resistant aluminum alloy products. One embodiment of a wear/corrosion resistant substrate is illustrated in FIG. 2. In the illustrated embodiment, the substrate 1 includes an aluminum alloy base 10, a sulfate-phosphate oxide zone 20, and a silicon-containing polymer zone 30. A first portion of the silicon-containing polymer zone overlaps with at least a portion of the sulfate-phosphate oxide zone 20, and thus defines a mixed zone 40. In other words, the sulfate-phosphate oxide zone 20 and the silicon-containing polymer zone 30 at least partially overlap, and this overlap defines a mixed zone 40. Thus, mixed zone 40 includes both sulfate-phosphate oxides and silicon-containing polymer. A polymer-free zone 60 may make up the remaining portion of the sulfate-phosphate oxide zone 20. A coating 50 may make up the remaining portion of the silicon-containing polymer zone 30. The coating 50 is located on an outer surface of the aluminum alloy base 10, and, since the coating 50 is integral with the sulfate-phosphate oxide zone 20 via the mixed zone 40, the coating 50 may be considered integral with the aluminum alloy base 10 via the mixed zone 40. In turn, increased adhesion between the coating 50 and the aluminum alloy base 10 may be realized relative to conventional anodized products.

Figure 3:
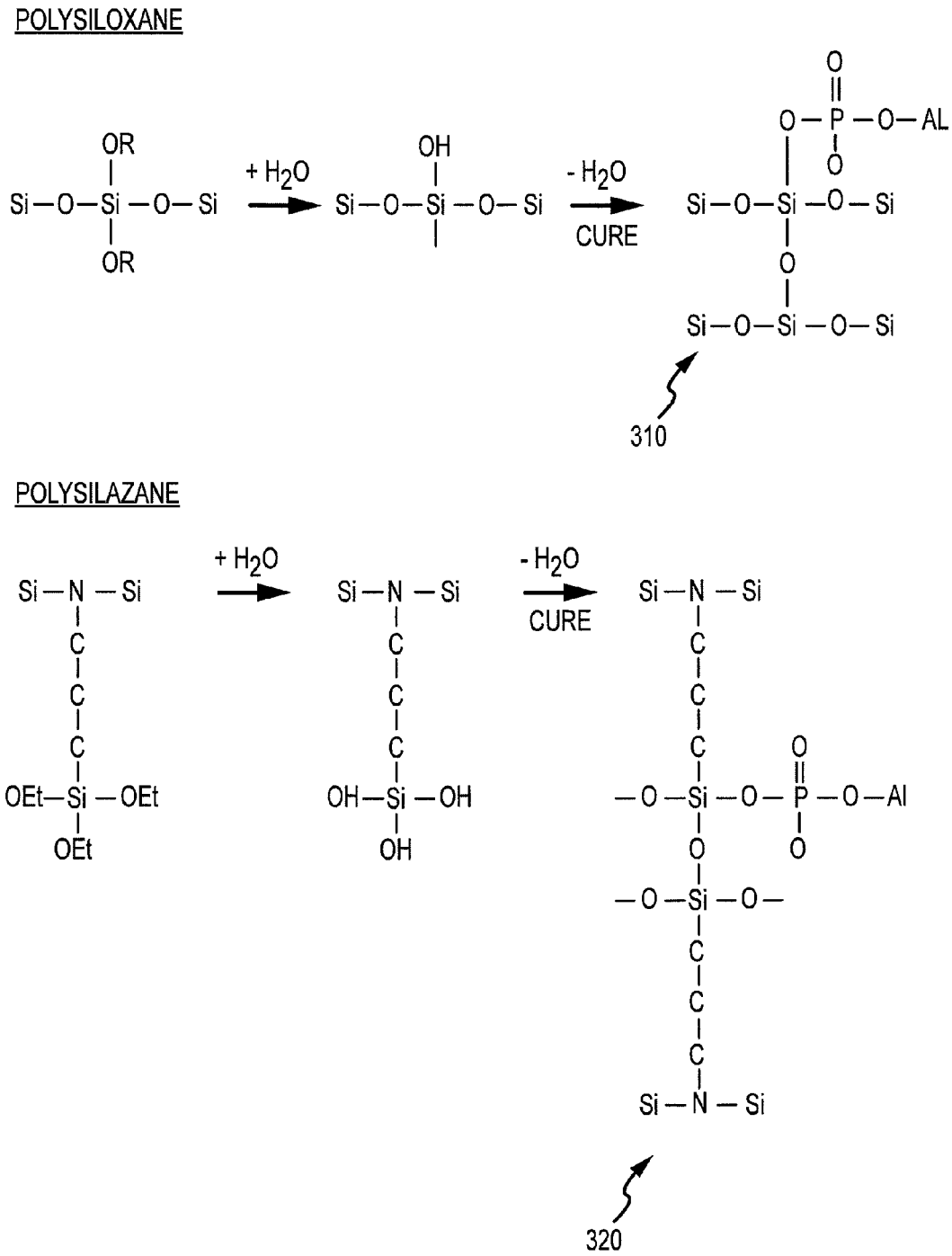
FIG. 3 is a schematic view of various reaction mechanisms that may occur in accordance with a sulfate-phosphate oxide zone and a silicon-based polymer.

As noted above, the sulfate-phosphate oxide zone 20 generally is porous. Thus, various amounts of silicon-containing polymer may be contained within the pores of the sulfate-phosphate oxide zone 20. In turn, adhesion between the sulfate-phosphate oxide zone 20 and the coating 50 may be facilitated. In particular, chemical bonding between the silicon-containing polymer and the sulfate-phosphate oxide zone 20 is believed to provide adhesive qualities heretofore unknown with respect to electrochemically treated aluminum substrates due to, for example, the molecular structure of the formed Al—O—P—O—Si compounds. It is believed that the Al—O—P—O—Si molecular structure is more stable than the molecular arrangements achieved with conventional anodizing processes (e.g., Al—O—Si, Al—O—P, Al—O—S, independently, and Al—O—S—O—Si). For example, the substrate 1 may be able to pass the ASTM D3359-02 (Aug. 10, 2002) tape adhesion test, in both dry and wet conditions. Examples of chemical reactions that may occur between polymers and the sulfate-phosphate oxides are illustrated in FIG. 3. Starting from their original colloid compositions, the chemical reactions that occur upon contact with water and subsequent curing may lead to a sequence of hydration and condensation reactions with the evolution of water, resulting in one or more new chemical structures within the sulfate-phosphate oxide zone involving sulfate-phosphate oxides and a silicon-based polymer. For example, the end products 310, 320 illustrated in FIG. 3 may be produced.

As used herein, "silicon-containing polymer" means a polymer comprising silicon and that is suited for integrating with at least a portion of the sulfate-phosphate oxide zone 20 (e.g., via chemical bonding and/or physical interactions). In this regard, the silicon-containing polymer should have a radius of gyration that is coincidental with the average pore size of the sulfate-phosphate oxide zone 20. Furthermore, since the silicon-containing polymer zone 30 may act as a barrier between outside environments and the aluminum alloy base 10, the silicon-containing polymer should generally be fluid impermeable. For appearance purposes, the silicon-containing polymer may be translucent, or even transparent, so as to facilitate preservation of the original specularity and aesthetic appearance of the finished product. Particularly, useful silicon-containing polymers having many of the above qualities include polysiloxanes (Si—O—Si) and polysilazanes (Si—N—Si). Polysiloxane polymers are available from, for example, SDC Coatings of Irvine, Calif., U.S.A. Polysilazane polymers are available from, for example, Clariant Corporation of Charlotte, N.C., U.S.A.

The selection of siloxane polymers versus silazane polymers may be dictated by the desired performance characteristics of the final product. Due to the dispersive nature of the siloxane precursor, which involves condensation during reaction with the sulfate-phosphate oxide zone 20, the resulting coefficient of thermal expansion of the polysiloxane compound may induce residual stresses at the surface of the coating 50, which may translate into surface fissures and/or cracks in the finished product, as described in further detail below. To avoid fissures and cracks with coatings 50 comprising polysiloxane, the thickness of the coating 50 may be restricted to not greater than 10 microns, or even not greater than 8 microns. Thus, for enhanced corrosion resistance, the barrier properties of the coating 50 may need to be increased via, for example, increased thickness. Substrates including coatings 50 produced from polysilazanes may have higher thicknesses than coatings produced with polysiloxanes and having similar fluid impermeable characteristics. It is believed that the flexibility and chemical composition of polysilazanes allow the production of end product 320, illustrated in FIG. 3, which, in turn, allows longer molecular chain lengths, and thus increased coating thicknesses with little or no cracking (e.g., fissure-free, crack-free surfaces). In one embodiment, the coating 50 is sufficiently thick to define a corrosion resistant substrate. The corrosion resistant substrate may be corrosion resistant while retaining a smooth surface and a glossy appearance (e.g., due to transparency of the coating 50 in combination with the appearance of the mixed zone 40). As used herein, "corrosion resistant substrate" means a substrate having an aluminum alloy base, a sulfate-phosphate oxide zone 20, and a silicon-containing polymer zone 30, and which is able to pass a 240 hour exposure to copper-accelerated acetic acid salt spray test, as defined by ASTM B368-97(2003)e1 (hereinafter the "CASS test"). In one embodiment, the corrosion resistant substrate is capable of substantially maintaining a glossy and translucent appearance while passing the CASS test. In this regard, the silicon-containing polymer may comprise a polysilazane and the coating 50 may have a thickness of at least about 8 microns. In one embodiment, the coating 50 has a thickness of at least about 35 microns. In one embodiment, the coating 50 has a thickness of at least about 40 microns. In one embodiment, the coating 50 has a thickness of at least about 45 microns. In one embodiment, the coating 50 has a thickness of at least about 50 microns. In some embodiments, the coatings 50 may realize little or no cracking. In this regard, it is noted that polysilazane has a coefficient of thermal expansion that is closer to the coefficient of thermal expansion of the aluminum alloy base 10 than polysiloxane coatings. For example, coatings comprising polysilazane may have a coefficient of thermal expansion of at least about $8\times10^{-5}$/° C. and aluminum-based substrates may comprise a coefficient of thermal expansion of about $22.8\times10^{-6}$/° C. Hence, the ratio of the coefficient of thermal expansion of the polysilazane coating to the coefficient of thermal expansion of the substrate may be not greater than about 10:1, such as not greater than about 7:1, or not greater than 5:1, or not greater than about 4:1, or not greater than about 3.5:1. Thus, in some instances, the coating 50 may comprise a coefficient of thermal expansion that is coincidental to a coefficient of thermal expansion of the aluminum alloy base 10 and/or the sulfate-phosphate oxide zone 20 thereof. Hence, coatings 50 comprising polysilazane may act as an impermeable or near-impermeable barrier between the aluminum alloy base 10 and other materials while maintaining a glossy appearance and a smooth outer surface. Nonetheless, the polysilazane coatings generally should not be too thick, or the coating may crack. In one embodiment, the coating 50 comprises polysilazane and has a thickness of not greater than about 90 microns, such as a thickness of not greater than about 80 microns.

As noted above, the coating 50 may have sufficient thickness to facilitate production of a corrosion resistant substrate and the corrosion resistant substrate may be capable of passing the CASS test. In other embodiments, the corrosion resistance of the coating 50 may be a lesser consideration in the final product design. Thus, the thickness of the coating 50 may be tailored based on the requisite design parameters. In one embodiment, the coating 50 comprises polysiloxane and has a thickness of not greater than about 10 microns, such as a thickness of not greater than about 8 microns.

Polymers other than silicon-based polymers may be used to produce a polymer-containing zone. Such polymers should posses a radius of gyration that is coincidental to the average pore size of the sulfate-phosphate oxide zone 20. Materials other than polymers may also be used to facilitate production of wear resistant and/or corrosion resistant substrates. For example, the sulfate-phosphate oxide zone 20 may optionally include dye and/or a nickel acetate preseal. With respect to dyes, ferric ammonium oxalate, metal-free anthraquinone, metalized azo complexes or combinations thereof may be utilized to provide the desired visual effect.

Figure 4:
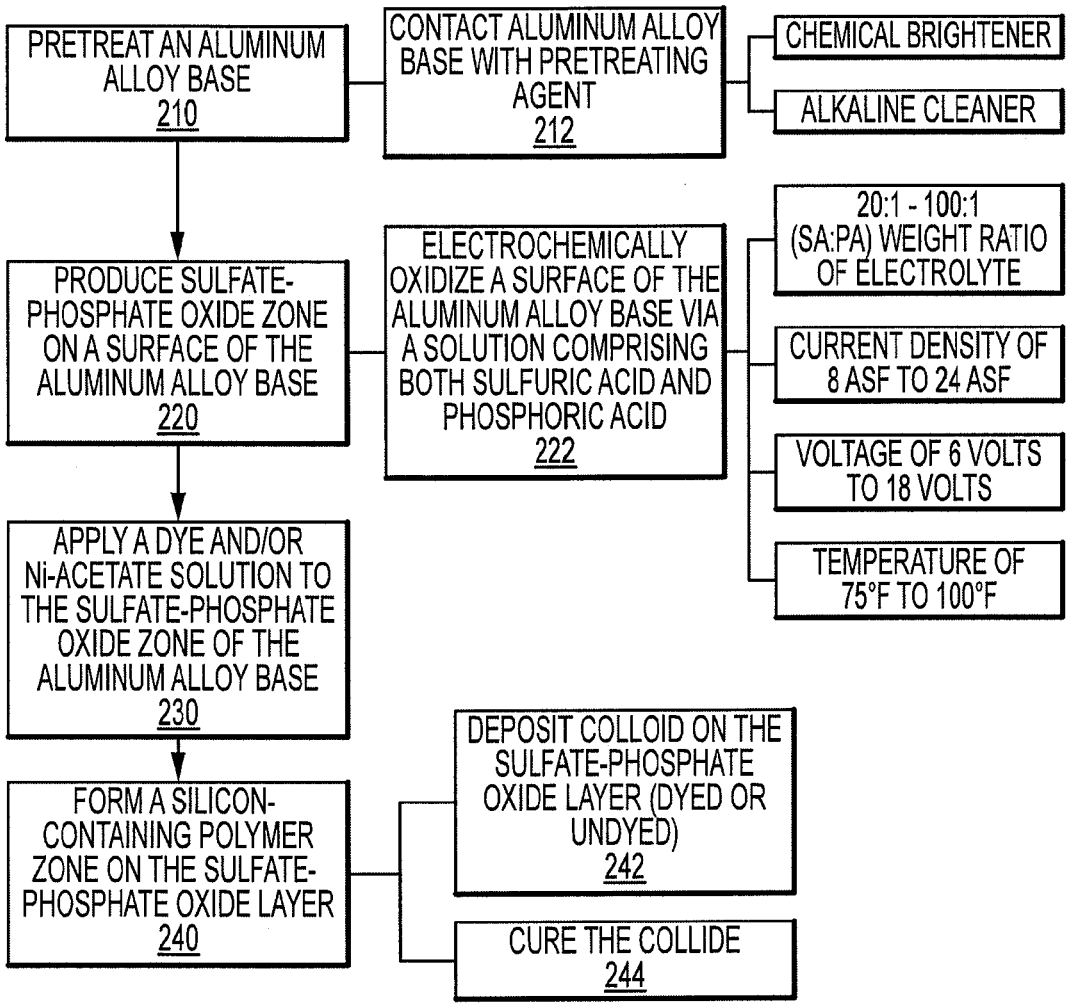
FIG. 4 is a flow chart illustrating methods of producing aluminum alloys having a sulfate-phosphate oxide zone and corrosion resistant substrates.

Methods of producing corrosion resistant substrates are also provided, one embodiment of which is illustrated in FIG. 4. In the illustrated embodiment, the method includes the steps of producing a sulfate-phosphate oxide zone on a surface of the aluminum alloy base (220) and forming a silicon-containing polymer zone on the sulfate-phosphate oxide zone (240). The method may optionally include the steps of pretreating an aluminum alloy base (210) and/or applying a dye to the sulfate-phosphate oxide zone (230). The aluminum alloy base, the sulfate-phosphate oxide zone and the silicon-containing polymer zone may be any of the above-described aluminum alloy bases, sulfate-phosphate oxide zones and silicon-containing polymer zones, respectively.

In one embodiment, and if utilized, a pretreating step (210) may comprise contacting the aluminum alloy base with a pretreating agent (212). For example, the pretreating agent may comprise a chemical brightening composition. As used herein, "chemical brightening composition" means a solution that includes at least one of nitric acid, phosphoric acid, sulfuric acid, and combinations thereof. For example, the methodologies disclosed in U.S. Pat. No. 6,440,290 to Vega et al. may be employed to pretreat an aluminum alloy base with a chemical brightening composition. In one approach, and with respect to 6XXX series alloys, a phosphoric acid-based solution with a specific gravity of at least about 1.65, when measured at 80° F. (about 26.7° C.) may be used, such as a phosphoric acid with a specific gravities in the range of from about 1.69 to about 1.73 at the aforesaid temperature. A nitric acid additive may be used to minimize a dissolution of constituent and dispersoid phases on certain Al—Mg—Si—Cu alloy products, especially 6XXX series forgings. Such nitric acid concentrations dictate the uniformity of localized chemical attacks between $Mg_2Si$ and matrix phases on these 6XXX series Al alloys. As a result, end product brightness may be positively affected in both the process electrolyte as well as during transfer from process electrolyte to a rinsing substep (not illustrated). In one approach, the nitric acid concentrations of may be about 2.7 wt. % or less, with more preferred additions of $HNO_3$ to that bath ranging between about 1.2 and 2.2 wt. %. For 6XXX series aluminum alloys, improved brightening may occur in those alloys whose iron concentrations are kept below about 0.35% in order to avoid preferential dissolution of Al—Fe—Si constituent phases. For example, the Fe content of these alloys may be kept below about 0.15 wt % iron. At the aforementioned specific gravities, dissolved aluminum ion concentrations in these chemical brightening baths should not exceed about 35 g/liter. The copper ion concentrations therein should not exceed about 150 ppm.

In another approach, the pretreating agent may include an alkaline cleaner. As used herein, "alkaline cleaner" means a composition having a pH of greater than approximately 7. In one embodiment, an alkaline cleaner has a pH of less than about 10. In one embodiment, an alkaline cleaner has a pH in the range of from about 7.5 to about 9.5. In one embodiment, the alkaline cleaner includes at least one of potassium carbonate, sodium carbonate, borax, and combinations thereof. In another embodiment, an alkaline cleaner has a pH of at least about 10.

In one embodiment, the pretreating step (210) includes removing contaminates from a surface of the aluminum alloy base. Examples of contaminates include grease, polishing compounds, and fingerprints. After the pretreating step (210), such as via chemical brighteners or alkaline cleaners, described above, the absence of contaminants on the surface of the aluminum alloy base may be detected by determining the wetability of a surface of the aluminum alloy base. When a surface of the aluminum alloy base wets when subjected to water, it is likely substantially free of surface contaminants (e.g., an aluminum alloy substrate that has a surface energy of at least about 72 dynes/cm).

Turning now to the producing a sulfate-phosphate oxide zone step (220), the sulfate-phosphate oxide zone may be produced via any suitable technique. In one embodiment, the sulfate-phosphate oxide zone is produced by electrochemically oxidizing a surface of the aluminum alloy base. As used herein, "electrochemically oxidizing" means contacting the aluminum alloy base with a electrolyte containing both (a) sulfuric acid and (b) phosphoric acid, and applying an electric current to the aluminum alloy base while the aluminum alloy base is in contact with the electrolyte.

The ratio of sulfuric acid to phosphoric acid within the electrolyte (sometimes referred to herein as a "mixed electrolyte") should be tailored/controlled so as to facilitate production of suitable sulfate-phosphate oxide zones. In one embodiment, the weight ratio of sulfuric acid (SA) to phosphoric acid (PA) in the electrolyte is at least about 5:1 (SA:PA), such as a weight ratio of at least about 10:1 (SA:PA), or even a weight ratio of at least about 20:1 (SA:PA). In one embodiment, the weight ratio of sulfuric acid to phosphoric acid in the electrolyte is not greater than 100:1 (SA:PA), such as a weight ratio of not greater than about 75:1 (SA:PA). In one embodiment, the mixed electrolyte comprises at least about 0.1 wt % phosphoric acid. In one embodiment, the mixed electrolyte comprises not greater than about 5 wt % phosphoric acid. In one embodiment, the mixed electrolyte comprises not greater than about 4 wt % phosphoric acid. In one embodiment, the mixed electrolyte comprises not greater than about 1 wt % phosphoric acid. In one embodiment, the phosphoric acid is orthophosphoric acid.

The current applied to the mixed electrolyte should be tailored/controlled so as to facilitate production of suitable sulfate-phosphate oxide zones. In one embodiment, electrochemically oxidizing step (222) includes applying electricity to the electrolyte at a current density of at least about 8 amps per square foot (asf), which is about 0.74 amps per square meter (asm). In one embodiment, the current density is at least about 12 asf (about 1.11 asm). In one embodiment, the current density is at least about 18 asf (about 1.67 asm). In one embodiment, the current density is not greater than about 24 asf (about 2.23 asm). Thus, the current density may be in the range of from about 8 asf to about 24 asf (0.74-2.23 asm), such as in the range of from about 12 asf to about 18 asf (1.11-1.67 asm).

The voltage applied to the mixed electrolyte should also be tailored/controlled so as to facilitate production of suitable sulfate-phosphate oxide zones. In one embodiment, the electrochemically oxidizing step (222) includes applying electricity to the electrolyte at a voltage of at least about 6 volts. In one embodiment, the voltage is at least about 9 volts. In one embodiment, the voltage is at least about 12 volts. In one embodiment, the voltage is not greater than about 18 volts. Thus, the voltage may be in the range of from about 6 volts to about 18 volts, such as in the range of from about 9 volts to about 12 volts.

The temperature of the electrolyte during the electrochemically oxidizing step (222) should also be tailored/controlled so as to facilitate production of suitable sulfate-phosphate oxide zones. In one embodiment, the electrochemically oxidizing step (222) includes heating the electrolyte to and/or maintaining the electrolyte at a temperature of at least about 75° F. (about 24° C.), such as a temperature of at least about 80° F. (about 27° C.). In one embodiment, the temperature of the electrolyte is at least about 85° F. (about 29° C.). In one embodiment, the temperature of the electrolyte is at least about 90° F. (about 32° C.). In one embodiment, the electrochemically oxidizing step (222) includes heating the electrolyte and/or maintaining the electrolyte at a temperature of not greater than about 100° F. (about 38° C.). Thus, the temperature of the electrolyte may be in the range of from about 75° F. (about 24° C.) to about 100° F. (38° C.), such as in the range of from about 80° F. (about 27° C.) to about 95° F. (35° C.), or a range of from about 85° F. (about 29° C.) to about 90° F. (about 32° C.).

In a particular embodiment, the electrochemically oxidizing step (222) includes utilizing a mixed electrolyte having: (i) a weight ratio of sulfuric acid to phosphoric acid of about 99:1 (SA:PA), and (ii) a temperature about 90° F. (about 32° C.). In this embodiment, the current density during electrochemically oxidizing step (222) is at least about 18 asf (about 1.11 asm).

After the sulfate-phosphate oxide zone is produced (220), the method may optionally include the step of presealing the sulfate-phosphate oxide zone (not illustrated) prior to or after the applying a dye step (230) and/or prior to the forming a silicon-containing polymer zone (240). In one approach, at least some, or in some instances all or nearly all, of the pores of the sulfate-phosphate oxide zone may be sealed with a sealing agent, such as, for instance, an aqueous salt solution at elevated temperature (e.g., boiling water) or nickel acetate.

Moving to the applying a dye step (230), in one embodiment the applying a dye step (230) comprises applying at least one of ferric ammonium oxalate, metal-free anthraquinone, metalized azo complexes or combinations thereof to at least a portion of a sulfate-phosphate oxide zone. The dye may be applied via any conventional techniques. In one embodiment, the dye is applied by a spray coating or dip coating.

Turning now to the forming a silicon-containing polymer zone step (240), in one embodiment the forming a forming a silicon-containing polymer zone step (240) includes depositing a colloid (e.g., a sol) on/in at least a portion of the sulfate-phosphate oxide zone (242), and curing the colloid (244). In a particular embodiment, the colloid is a sol and the curing step (244) results in the formation of a gel comprising the silicon-containing polymer zone. The depositing step (242) may accomplished via any conventional process. Likewise, the curing step (244) may be accomplished via any conventional process. In one embodiment, the depositing step (242) is accomplished by one or more of spray coating or dip coating, spin coating or roll coating. In another embodiment, the depositing step (242) is accomplished by vacuum deposition from liquid and/or gas phase precursors. The silicon-containing polymer zone may be formed on a dyed sulfate-phosphate oxide zone or an undyed sulfate-phosphate oxide zone.

Colloids used to form the silicon-containing polymer zone generally comprise particles suspended in a liquid. In one embodiment, the particles are silicon-containing particles (e.g., precursors to the silicon-containing polymer). In one embodiment, the particles have a particle size in the range of from about 1.0 nm to about 1.0 micron. In one embodiment, the liquid is aqueous-based (e.g., distilled $H_2O$). In another embodiment, the liquid is organic based (e.g., alcohol). In a particular embodiment, the liquid comprises at least one of methanol, ethanol, or combinations thereof. In one embodiment, the colloid is a sol.

The viscosity of the colloid may be tailored based on deposition method. In one embodiment, the viscosity of the colloid is about equal to that of water. In this regard, the particles of the colloid may more freely flow into the pores of the sulfate-phosphate oxide zone. During or concomitant to the depositing step (242), the colloid may flow into the pores of the sulfate-phosphate oxide zone, and may thus seal the pores by condensation of the colloid to a gel state (e.g., via heat). Water released during this chemical reaction may induce oxide hydration and, therefore, sealing of the pores. In a particular embodiment, the colloid may flow into a substantial amount of (e.g., all or nearly all) the pores of the sulfate-phosphate oxide zone. In turn, during the curing step (244), the silicon-containing polymer is formed and seals a substantial amount of the unsealed pores of the sulfate-phosphate oxide zone. In this embodiment, the curing step (244) may include applying a temperature of from about 90° C. (about 194° F.) to about 170° C. (about 338° F.). In one embodiment, the curing step may include applying a temperature of from about 138° C. (about 280° F.) to about 160° C. (about 320° F.).

In one embodiment, the curing step (244) results in the production of a polysiloxane coating (e.g., via gelation of the colloid). In one embodiment, the curing step (244) results in the production of a coating comprising polysilazane. In this regard, the colloid may include silane precursors, such as trimethoxy methyl silanes, or silazane precursors, such as methyldichlorine or aminopropyltriethoxysilane reacted with ammonia via ammonolysis synthesis. As noted above, the use of polysilazanes versus polysiloxanes is primarily a function of the desired corrosion resistance and film thickness of the final product.

EXAMPLES

Example 1

Testing of Polysiloxane Coating with Conventional Type II Anodized Sheet

A 6061-T6 aluminum alloy sheet is anodized via a conventional Type II anodizing process in a sulfuric acid only electrolyte (10-20 w/w % sulfuric acid, MIL-A-8625F). The sheet is anodized at 75° F. (about 23.9° C.) at a current density of 12 asf (about 1.11 asm). The sheet is dyed and sealed via a conventional nickel acetate sealing process (e.g., sealing in an aqueous nickel acetate solution at 190° F.-210° F., about 87.8° C.-98.9° C.). The sheet is coated with a sol comprising polysiloxane, and the sol is then cured to form a gel coating comprising polysiloxane on the sheet. The sheet has a dull appearance and the gel coating does not pass ASTM D3359-02, Aug. 10, 2002 (hereinafter, the "Scotch Tape 610 test"), as coating is removed from the substrate surface via the tape.

Example 2

Testing of Polysiloxane Coating to Conventional Type II Anodized Sheet with Pretreatment A 6061-T6 aluminum alloy sheet is prepared similar to Example 1, except that the sheet is pretreated with an alkaline cleaner and is chemically brightened prior to anodizing. The anodizing conditions remain the same. The sheet is coated with the sol composition of Example 1, and the sol is then cured to form a gel coating comprising polysiloxane on the sheet. The sheet has dull/matte appearance after curing. The sheet is tested in accordance with ASTM D2247-02, Aug. 10, 2002 (hereinafter the "army-navy test") for 1000 hours. The coated sheet does not pass the army-navy testing as the coating is not adherent to the surface as tested via the Scotch 610 tape test.

Figure 5A:
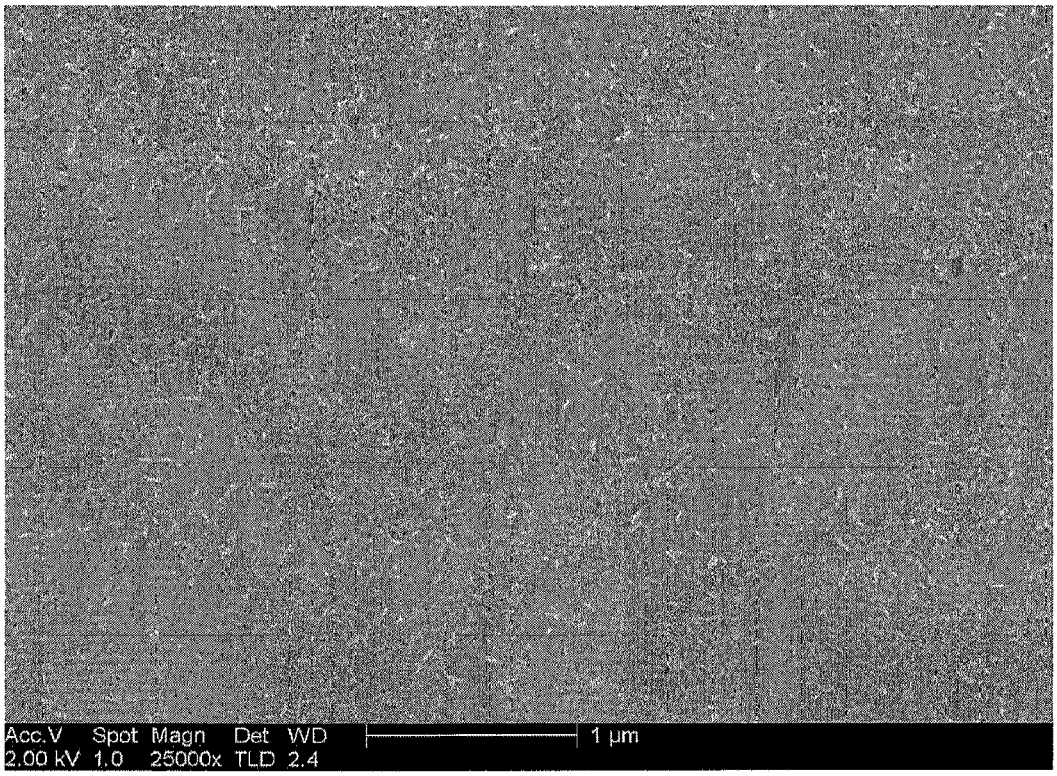
FIG. 5*a* is an SEM image (25000× magnification) of an anodized 6061 series alloy that has been anodized with a conventional Type II anodizing process.
Figure 5B:
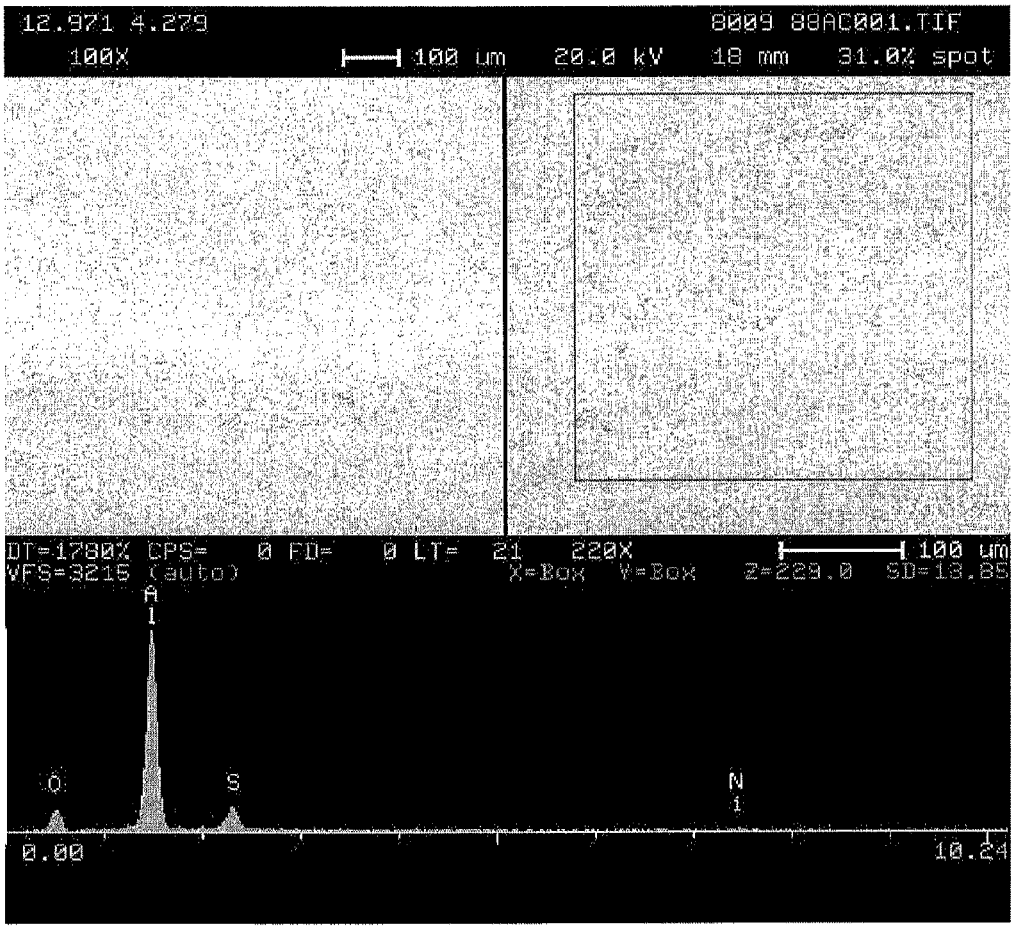
FIG. 5*b* is an energy dispersive spectroscopy (EDS) image obtained via x-ray analysis of the alloy of FIG. 5*a*.

SEM micrographs of the surface treated sample reveal the original topography of the sample under as-anodized conditions, as exhibited in FIG. 5*a*. Additional x-ray analysis of this sample via Energy Dispersive Spectroscopy (EDS) verifies the absence of silicon on the sample surface as shown in FIG. 5*b*. The results of this example, and Example 1, indicate that adhesion of silicon polymers to Type II anodized surfaces is problematic, and that the pretreatment consisting of alkaline cleaner and chemical brightening does not have any significant effect on adhesion properties.

Example 3

Adhesion Testing of Polysiloxane Coating to Surface Treated Sheet Processed in Mixed Electrolyte An aluminum alloy 6061-T6 test sheet is provided. The sheet is pretreated with an alkaline cleaner and is chemical brightened. The sheet is surface treated in a mixed electrolyte comprising 96 wt % sulfuric acid and 4 wt % phosphoric acid at about 90° F. (about 32.2° C.) and a current density of about 18 asf (about 1.67 asm). A sulfate-phosphate oxide zone is created in the processed sheet. The thickness of each of the sulfate-phosphate oxide zones is at least about 0.00020 inch (about 5 microns) as measured using an Eddy current probe. The sheet is dyed in an aqueous dye solution. The sheet is then sealed in an aqueous nickel acetate bath at about 190° F. (about 87.8° C.). The sheet is subsequently coated with the same sol of Example 1, and a gel is formed on the sheet. The sheet is subjected to the army-navy test for 1000 hours. The sheet passes the army-navy test as the coating is adherent to the sheet using the Scotch 610 tape pull test. Furthermore, the sheet has a bright, glossy appearance.

Figure 6A:
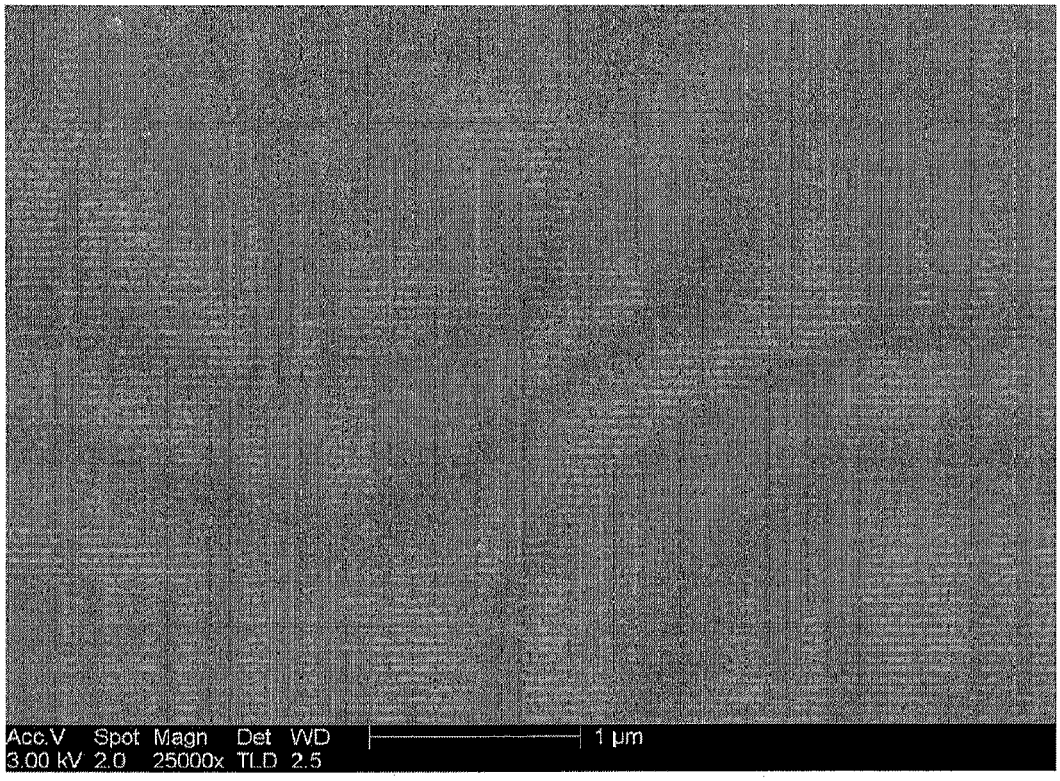
FIG. 6*a* is an SEM image (25000× magnification) of a 6061 series alloy that has been surface treated with a mixed electrolyte.
Figure 6B:
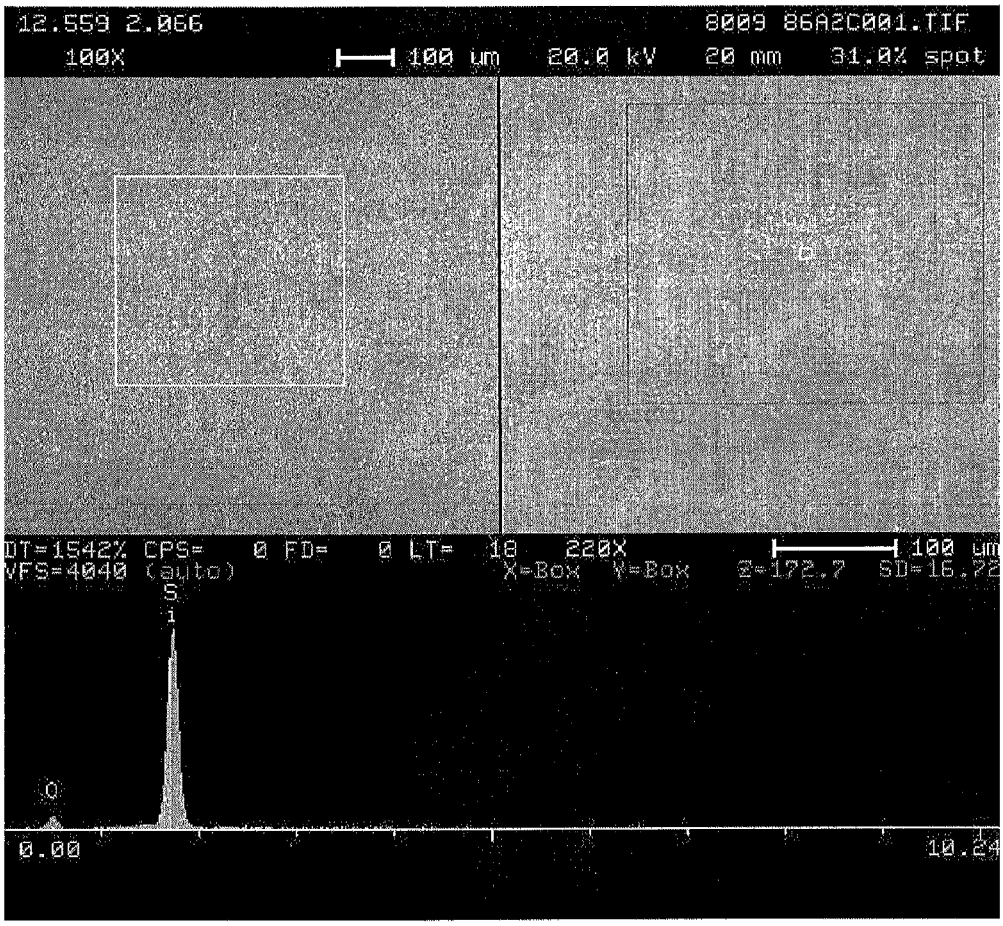
FIG. 6*b* is an energy dispersive spectroscopy (EDS) image obtained via x-ray analysis of the alloy of FIG. 6*a*.
Figure 6C:
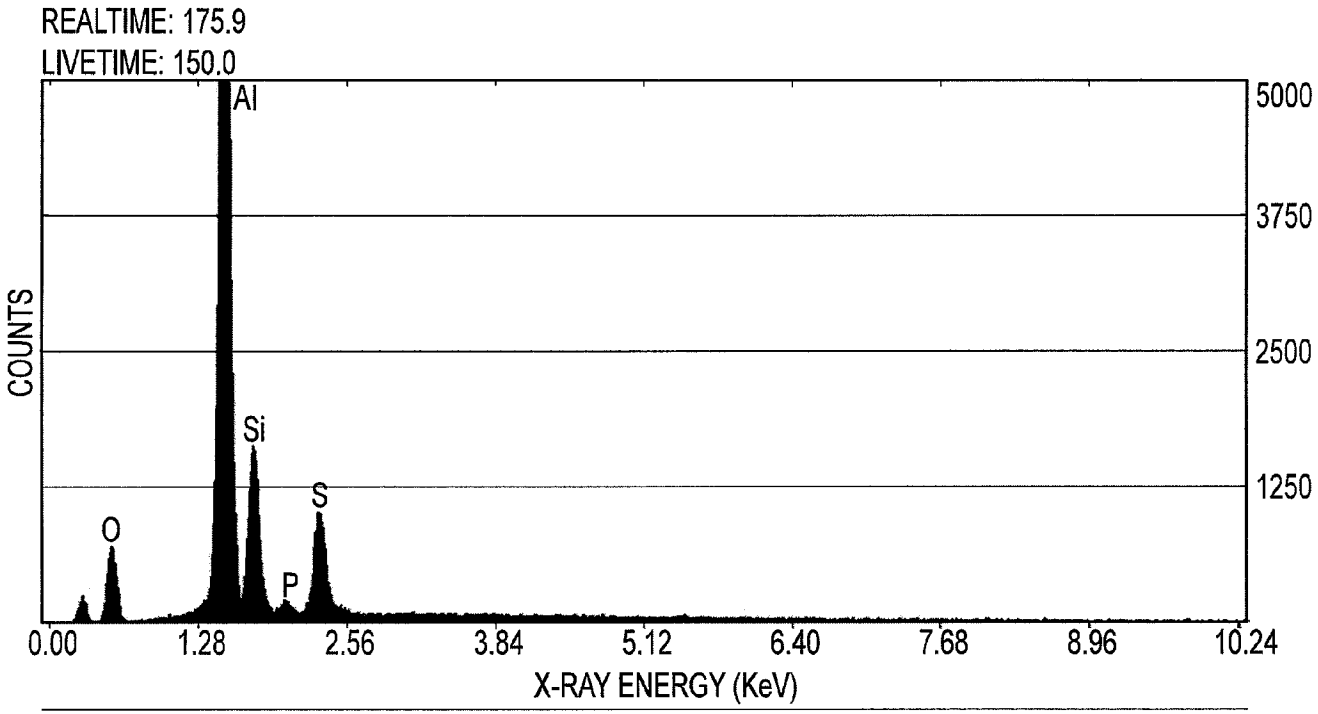
FIG. 6*c* is another energy dispersive spectroscopy (EDS) image obtained via x-ray analysis of the alloy of FIG. 6*a*.

SEM micrographs of the surface treated sample reveal the original topography of the sample under as-processed conditions, as exhibited in FIG. 6*a*. Additional x-ray analysis of this sample via Energy Dispersive Spectroscopy (EDS) verifies the presence of silicon on the sample surface as shown in FIG. 6*b*. These results indicate that adhesion of silicon polymers to aluminum alloys surface treated with a mixed electrolyte comprising sulfuric acid and phosphoric acid may realize increased adhesion between the aluminum alloy base and the silicon polymer coating relative to conventionally processed aluminum alloy substrates. An additional EDS scan of the surface indicates the presence of phosphorus on the surface of the substrate as shown in FIG. 6*c*.

Example 4

Corrosion Testing of Polysiloxane Coating to Surface Treated Sheet Processed in Mixed Electrolyte An aluminum alloy 6061-T6 test sheet is provided and prepared as provided in Example 3, except that the sheet is not sealed in nickel acetate solution. The sheet is subjected to the army-navy test for 1000 hours. The sheet passes the army-navy test as the coating passes the Scotch 610 tape test. The sheet is further subjected to a copper-accelerated acetic acid salt spray test (CASS) in accordance with ASTM B368-97 (2003)e1 (hereinafter the "CASS test"). The sheet does not pass the CASS test. It is postulated that the silicon polymer coating of the gel does not provide sufficient barrier characteristics against the copper ions of the CASS test migrating through the coating and chemically reacting with the aluminum alloy base.

Example 5

Corrosion Testing of Polysiloxane Coating to Surface Treated Sheet Processed in Mixed Electrolyte An aluminum alloy 6061-T6 test sheet is provided and prepared as provided in Example 4, except that the sol coating is applied multiple times to provide a gel coating having an increased thickness. The final thickness of the gel coating is about 8 microns. The sheet is subjected to the army-navy test for 1000 hours. The sheet passes the army-navy test as the coating passes the Scotch 610 tape test. The sheet is further subjected to the CASS test. The sheet passes the CASS test. Unfortunately, the coating contains cracking, giving it an undesirable appearance.

Example 6

Corrosion Testing of Polysilazane Coating to Surface Treated Sheet Processed in Mixed Electrolyte An aluminum alloy 6061-T6 test sheet is provided and prepared as provided in Example 4, except that the coating is a polysilazane-based coating. The coating is applied multiple times to provide a gel coating having an increased thickness. The final thickness of the gel coating is about 8 microns, but the coating comprises polysilazanes instead of the polysiloxanes of Example 5. The sheet is subjected to the army-navy test for 1000 hours. The sheet passes the army-navy test as the coating passes the Scotch 610 tape test. The sheet is further subjected the CASS test. The sheet passes the CASS test. The coating is crack-free.

Example 7

Fatigue Performance of Wheels Having a Sulfate-Phosphate Oxide Zone

Four wheel samples (wheels 1-4) are produced from AA6061 in a T6 temper. The wheels have a 17-inch diameter (about 43.2 cm) and an 8-inch width (about 20.3 cm). The wheels are pretreated with an alkaline cleaner and are chemically brightened. One of the wheels is not anodized (wheel 1), while the remaining three wheels are anodized in a mixed electrolyte comprising sulfuric acid (96 wt. %) and phosphoric acid (4 wt. %) at about 90° F. (about 32.2° C.). Wheel 2 is anodized at 8 asf (about 0.74 asm) and produces a sulfate-phosphate oxide zone having a thickness of about 5.6 microns. Wheel 3 is anodized at 12 asf (about 1.11 asm) and produces a sulfate-phosphate oxide zone having a thickness of about 8.9 microns. Wheel 4 is anodized at 18 asf (about 1.67 asm) and produces a sulfate-phosphate oxide zone having a thickness of about 13.7 microns. Wheels 2-4 are coated with a polysilazane-based coating similar to that described in Example 6, above, thereby creating a gel coating. The gel coating is air-dried for 10-30 minutes, and then cured for about 30 minutes at about 300° F. (about 149° C.). Wheel 1 is left in its pretreated condition.

Figure 7:
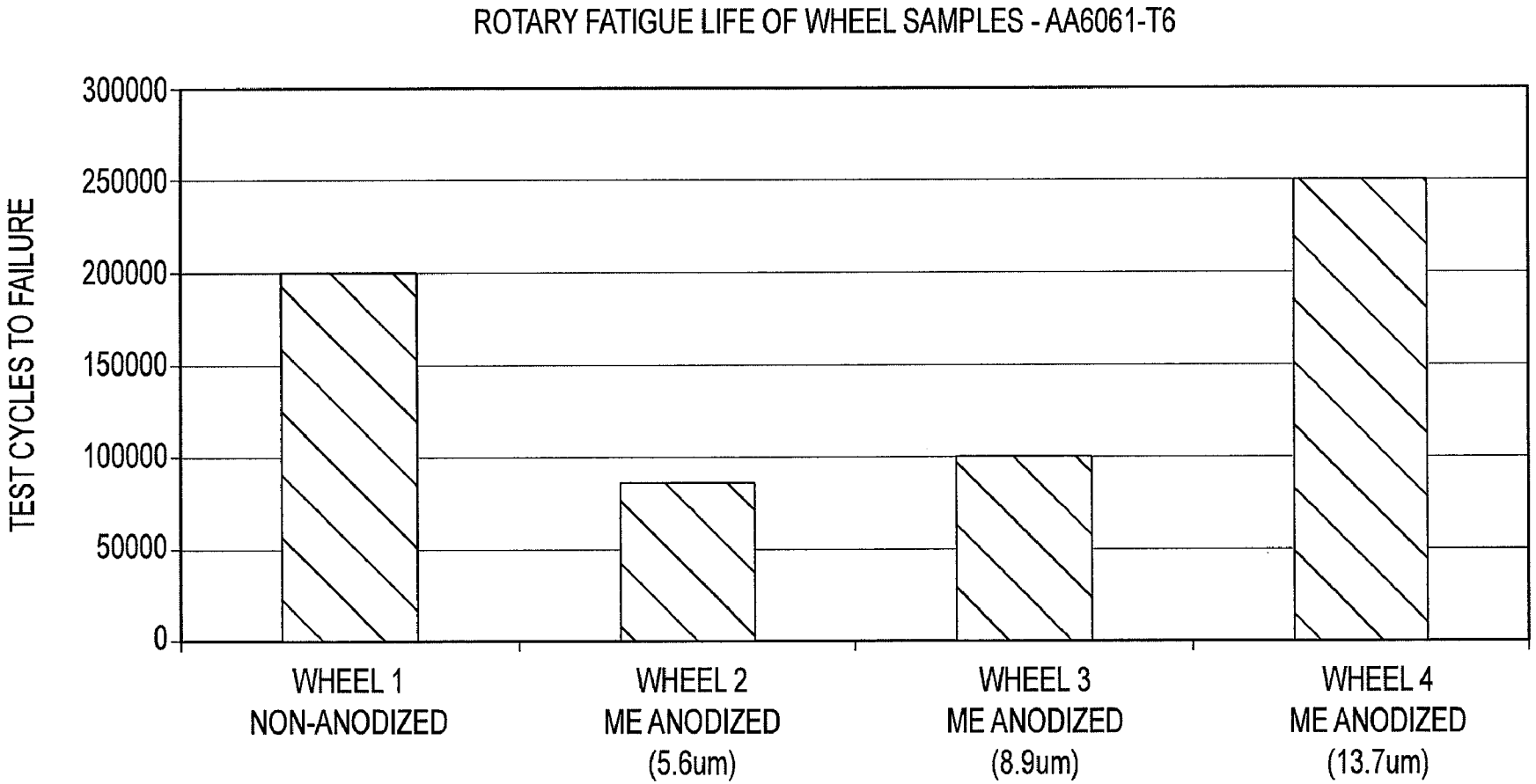
FIG. 7 is a graph illustrating fatigue life performance of various wheel products.

Wheels 1-4 are subjected to rotary fatigue testing in accordance with SAE-J328. As illustrated in FIG. 7, the wheels anodized in the mixed electrolyte and having an oxide thickness of 5.9 microns (wheel 2) and 8.9 microns (wheel 3) generally do not perform as well as the non-anodized wheel (wheel 1). Wheel 1 realizes a log average fatigue life of about 200,000 cycles, whereas wheels 2 and 3 realize a log average fatigue life of 85,600 cycles and 100,000 cycles, respectively. However, and unexpectedly, wheel 4, which is anodized in the mixed electrolyte and has an oxide thickness of about 13.7 microns, realizes a fatigue life that is better than that of the non-anodized wheel, achieving a log average fatigue life of about 250,000 cycles, or an improvement of about 25% over the fatigue life of the non-anodized wheel.

Example 8

Fatigue Performance of Wheels Having a Sulfate-Phosphate Oxide Zone

Three wheel samples (wheels 5-7) are produced from AA6061 in a T6 temper. The wheels have a 17-inch diameter (about 43.2 cm) and an 8-inch width (about 20.3 cm). The wheels are pretreated with an alkaline cleaner and are chemically brightened. One of the wheels is not anodized (wheel 5), while the remaining two wheels are anodized in a mixed electrolyte comprising sulfuric acid (96 wt. %) and phosphoric acid (4 wt. %) at about 90° F. (about 32.2° C.). Wheel 6 is anodized at 18 asf (about 1.67 asm) and produces a sulfate-phosphate oxide zone having a thickness of about 12.7 microns. Wheel 7 is anodized at 24 asf (about 2.23 asm) and produces a sulfate-phosphate oxide zone having a thickness of about 17.3 microns.

Wheels 6 and 7 are coated with a polysilazane-based coating similar to that described in Example 6, above, thereby creating a gel coating. The gel coating is air-dried for 10-30 minutes, and then cured for about 30 minutes at about 300° F. (about 149° C.). Wheel 5 is left in its pretreated condition.

Figure 8:
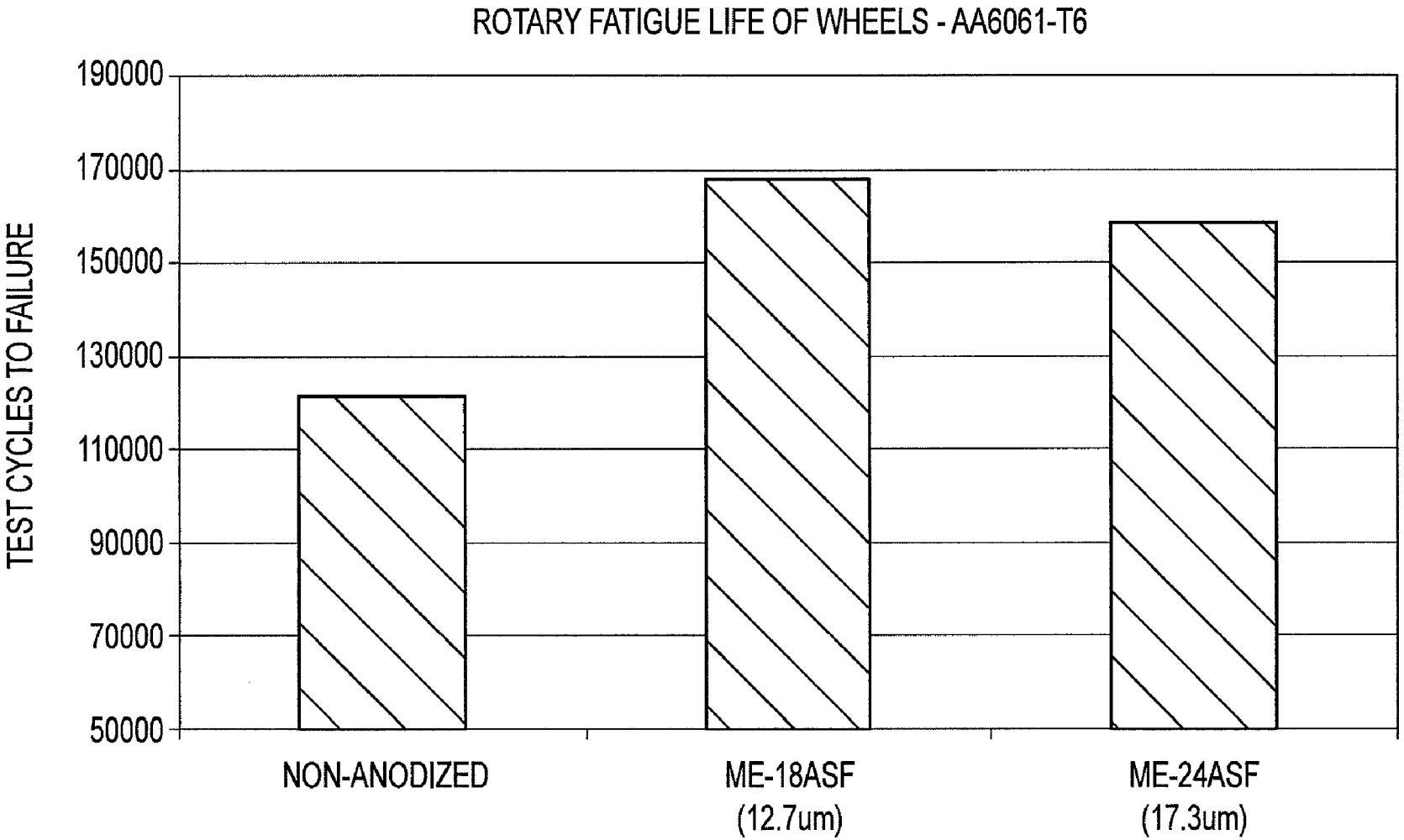
FIG. 8 is a graph illustrating fatigue life performance of various wheel products.

Wheels 5-7 are subjected to rotary fatigue testing in accordance with SAE-J328m. As illustrated in FIG. 8, the wheels anodized in the mixed electrolyte and having an oxide thickness of 12.7 μm (wheel 6) and 17.3 μm (wheel 7) perform better than the non-anodized wheel (wheel 5). Wheel 5 realizes a fatigue life of about 121,330 cycles, whereas wheels 6 and 7 realize a fatigue life that is better than that of wheel 1, achieving fatigue lives of about 167,685 cycles and 158,394 cycles, respectively, or an improvement of about 38% and 31%, respectively, over the fatigue life of wheel 5.

Example 9

Fatigue Performance of Rotating Beams Having a Sulfate-Phosphate Oxide Zone

AA6061 is forged in a T6 temper. R.R. Moore style rotating beams are formed from the forged alloy. The beams have a length of 3 inches (about 7.6 cm), a 0.375 inch diameter (about 0.95 cm), and a gauge length of 1 inch (about 2.54 cm). The beams are pretreated with an alkaline cleaner. A first set of beams is not anodized (non-anodized beams). A second set of beams is anodized in a conventional Type II anodizing process in a sulfuric acid only electrolyte producing a sulfur-only oxide zone having a thickness of about 7 microns. A third set of beams is anodized in a conventional Type II anodizing process in a sulfuric acid only electrolyte producing a sulfur-only oxide zone having a thickness of about 17 microns. A fourth set of beams is anodized in a conventional Type II anodizing process in a sulfuric acid only electrolyte producing a sulfur-only oxide zone having a thickness of about 27 microns. A fifth, sixth, and seventh set of beams are anodized in a mixed electrolyte comprising sulfuric acid (96 wt. %) and phosphoric acid (4 wt. %) at about 90° F. (about 32.2° C.). The fifth set is processed at about 12 asf (about 1.11 asm) and produces an oxide thickness of about 8 microns. The sixth set is processed at about 18 asf (about 1.67 asm) and produces an oxide thickness of about 11 microns. The seventh set is processed at about 24 asf (about 2.23 asm) and produces an oxide thickness of about 17 microns. Half of the fifth, six, and seventh sets are then dyed via a conventional dye immersion technique, and the other half of the fifth, sixth and seventh sets are left undyed. The fifth, sixth and seventh sets are then coated with a polysilazane-based coating similar to that described in Example 6, above, thereby creating a gel coating on each of the beams. The gel coating is air-dried for 10-30 minutes, and then cured for about 30 minutes at about 300° F. (about 149° C.).

All beams are subjected to fatigue testing in accordance with ASTM E-466-96. The results of the fatigue tests are illustrated in FIGS. 9*a*-9*d*. Beams that did not fail after a predetermined amount of cycles (e.g., 10 million) at a predetermined amount of applied stress are not included in the data.

Figure 9A:
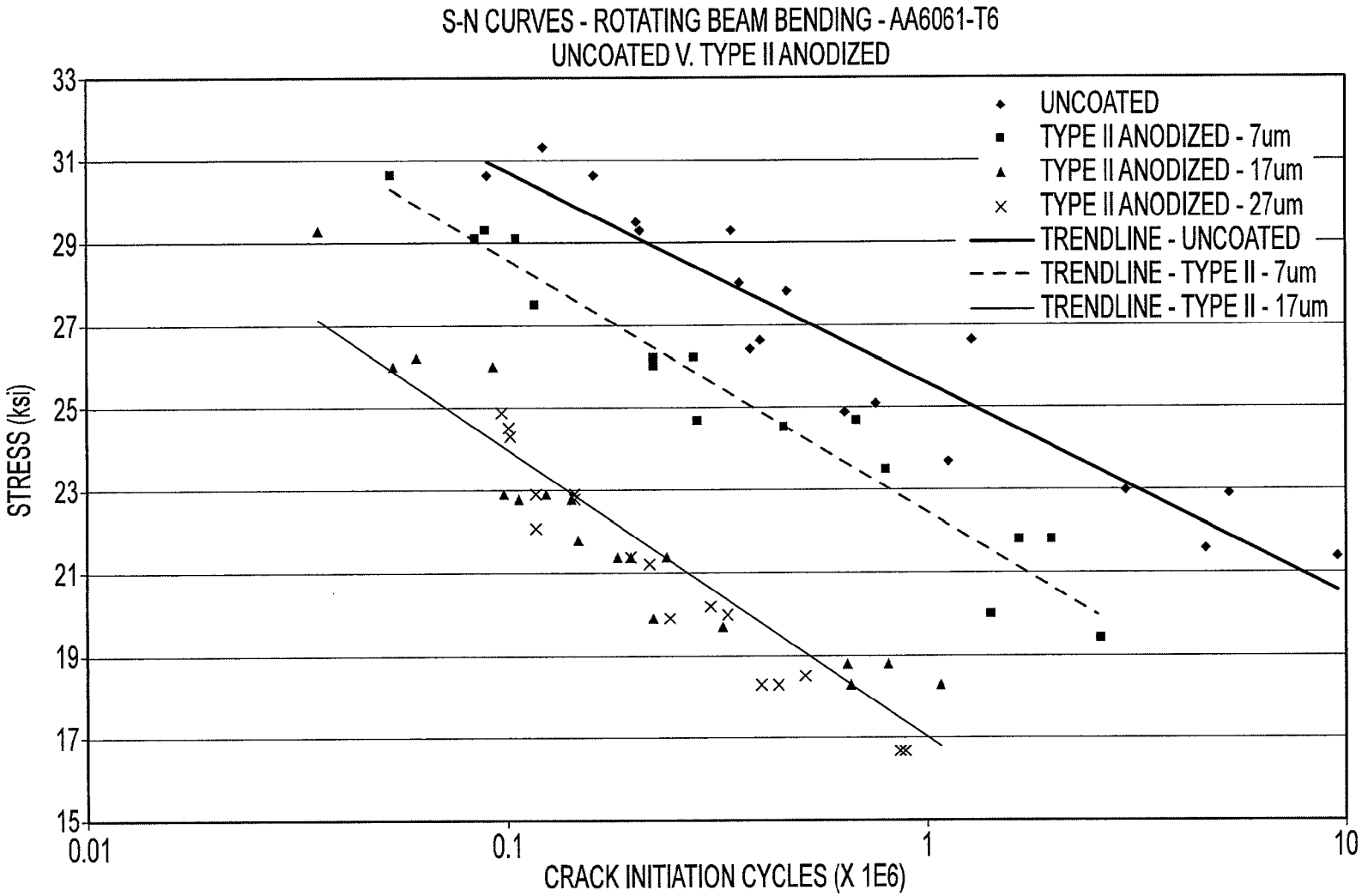
FIGS. 9*a*-9*d* are graphs illustrating the fatigue performance of the various rotating beams at varying stress.

As illustrated in FIG. 9*a*, the uncoated beams realize a fatigue life that is significantly better than the Type II anodized beams, the non-anodized beams having a higher crack initiation stress threshold that is from about 6 ksi (about 41.4 MPa) to 10 ksi (about 69 MPa) higher than the Type II anodized beams having an oxide thickness of 17 μm. The logarithmic trendlines of the uncoated, Type II 7 μm and Type II 17 μm samples are included in the graph to illustrate the effect of Type II anodizing. The trend of the Type II 27 μm sample is not included, but is similar to that of the Type II 17 μm samples. The logarithmic trendline of the uncoated samples has an equation of $y=-2.2262\ Ln(x)+25.597$, where y is the applied net stress, and x is the one-millionth the number of cycles to crack initiation, and with an $R^2$ value of 0.894. The logarithmic trendline of the Type II 7 μm samples has an equation of $y=-2.6674\ Ln(x)+22.454$, and an $R^2$ value of 0.9458. The logarithmic trendline of the Type II 17 μm samples has an equation of $y=-3.0182\ Ln(x)+17.067$, and with an $R_2$ of 0.8779.

Figure 9B:
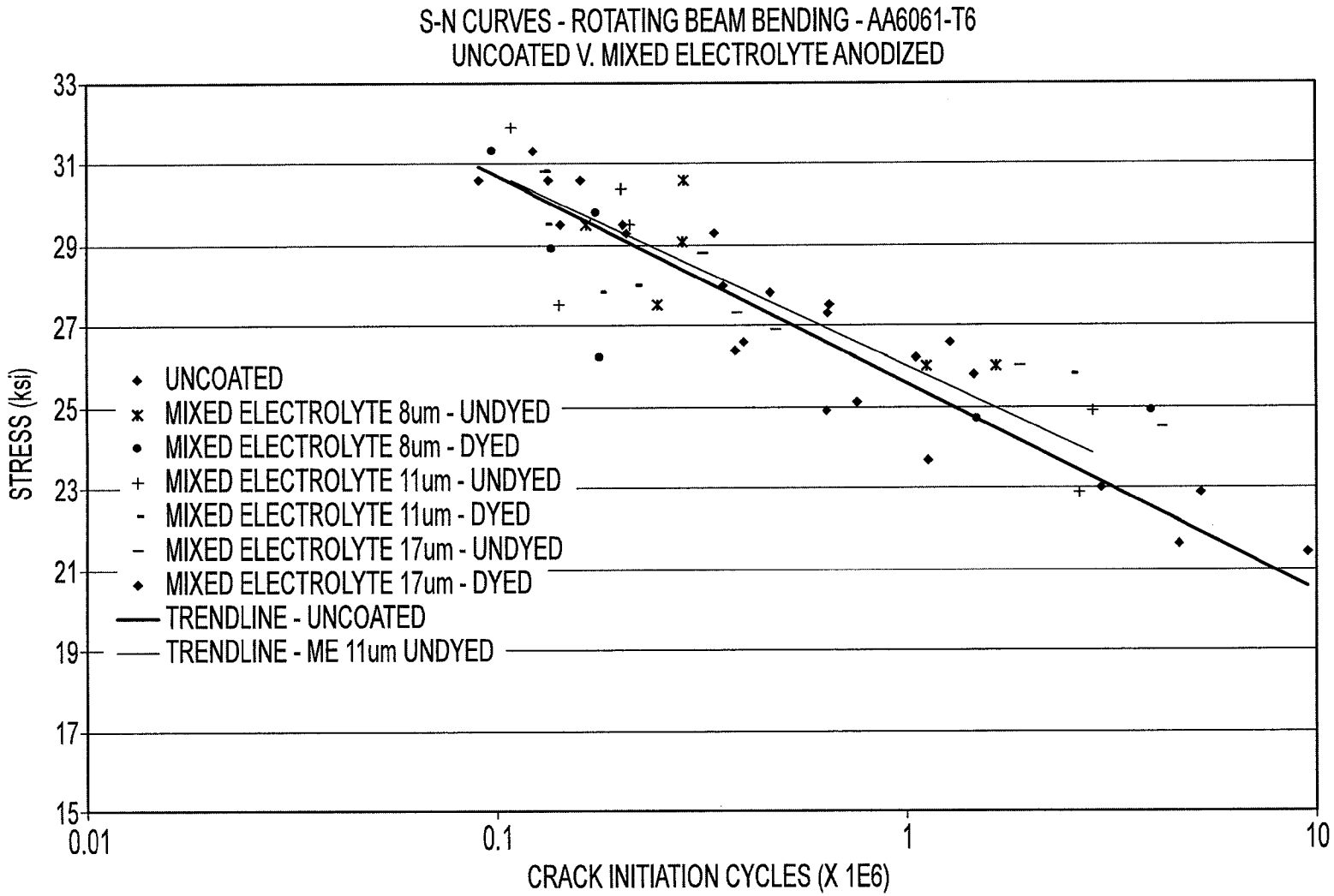

As illustrated in FIG. 9*b*, the mixed electrolyte beam realizes about the same (or better) fatigue life than the uncoated beams, irrespective of dying. As noted above, the logarithmic trendline of the uncoated samples has an equation of $y=-2.2262\ Ln(x)+25.597$. The logarithmic trendline of the ME 11 μm undyed samples, which is similar to the trendlines of the other mixed electrolyte beams, has an equation of $y=-2.0703\ Ln(x)+26.023$ and an $R^2$ value of 0.8007.

Figure 9C:
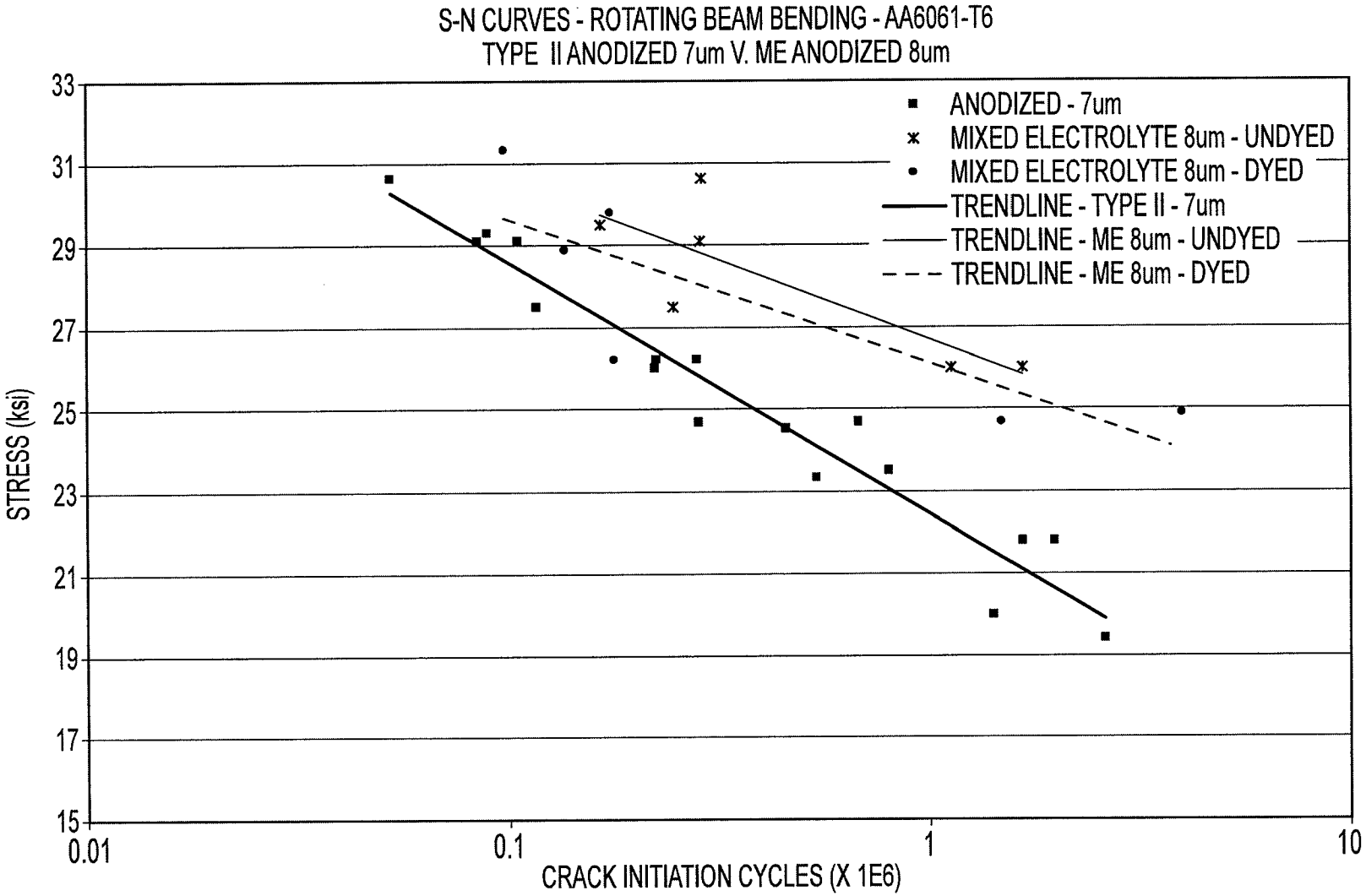
Figure 9D:
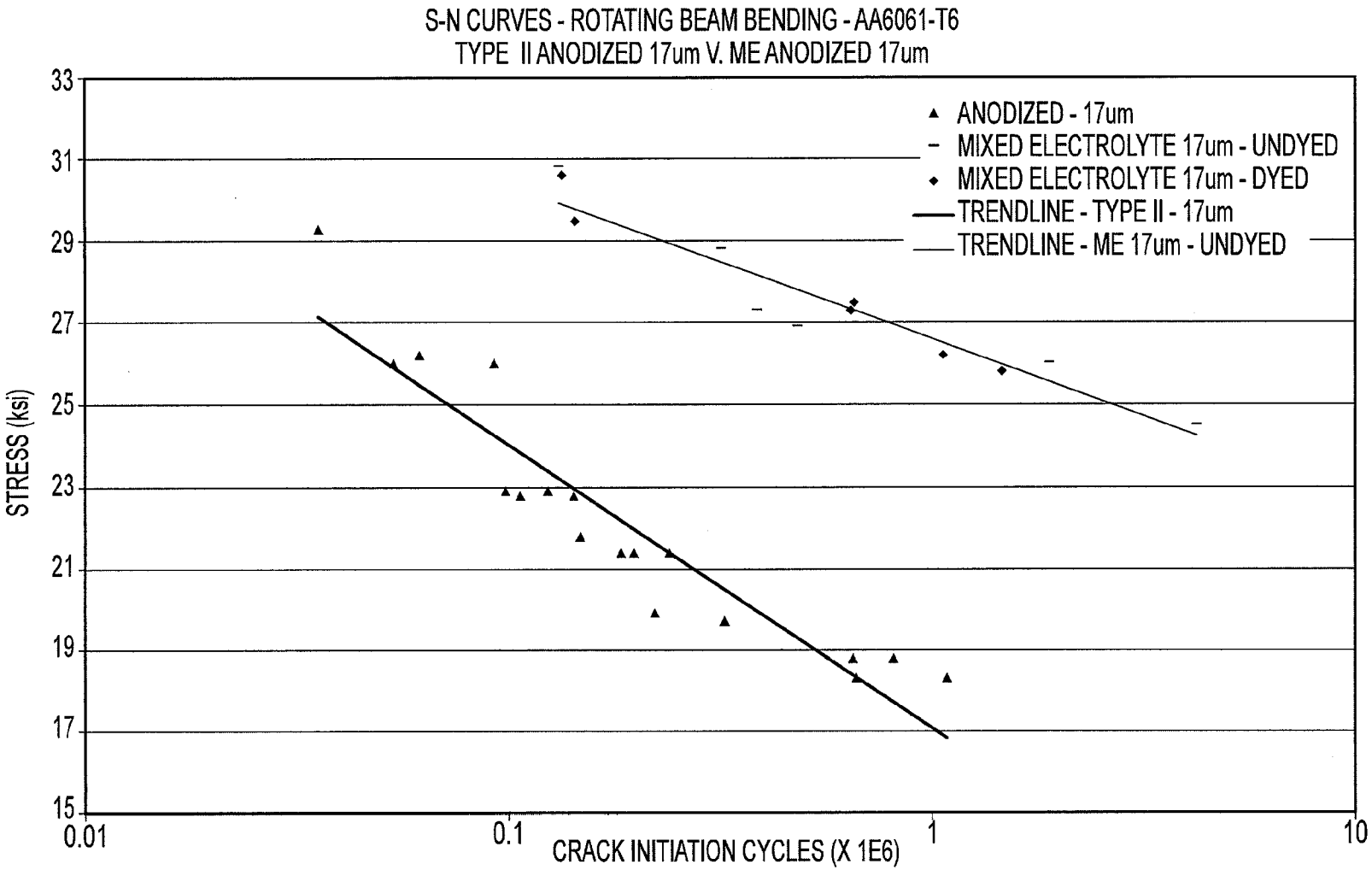

As illustrated in FIGS. 9*c* and 9*d*, the mixed electrolyte beams realize a better fatigue life than the uncoated beams, irrespective of dying, at similar oxide thicknesses (e.g., +/−10% of the oxide thickness of the comparative non-mixed electrolyte substrate). For instance, and with reference to FIG. 9*c*, the trendlines of the mixed electrolyte at 8 μm illustrate the improvement in fatigue life of the mixed electrolyte beams. As noted above, the logarithmic trendline of the Type II 7 μm samples has an equation of $y=-2.6674\ Ln(x)+22.454$. The logarithmic trendline of the ME 8 μm undyed sample has an equation of $y=-1.6918\ Ln(x)+26.685$ and an $R^2$ value of 0.6683. The logarithmic trendline of the ME 8 μm dyed sample has an equation of $y=-1.5154\ Ln(x)+26.119$ and an $R^2$ value of 0.6903. Thus, the mixed electrolyte beams realize a better fatigue life than the uncoated beams, irrespective of dying, at an oxide thickness of about 7-8 μm.

With reference to FIG. 9*c*, the trendlines of the mixed electrolyte at 8 μm illustrate the improvement in fatigue life of the mixed electrolyte beams. As noted above, the logarithmic trendline of the Type II 17 μm samples has an equation of $y=3.0182\ Ln(x)+17.067$. The logarithmic trendline of the ME 17 μm undyed sample has an equation of $y=-1.6345\ Ln(x)+26.627$ and an $R^2$ value of 0.8897. The logarithmic trendline of the ME 17 μm dyed sample (trendline not illustrated for ease of illustration) has an equation of $y=-1.8217\ Ln(x)+26.486$ and an $R^2$ value of 0.9678. Thus, the mixed electrolyte beams realize a better fatigue life than the uncoated beams, irrespective of dying, at an oxide thickness of about 17 μm.

Example 10

Fatigue Performance of Rotating Beams Having a Sulfate-Phosphate Oxide Zone and after Exposure to a Neutral pH Salt Solution AA2014 is forged in a T6 temper. R.R. Moore style rotating beams (per 5E3-6169) are formed from the forged alloy. The beams have a length of about 3.44 inches (8.73 cm), a 0.5 inch width (about 1.27 cm), and a gauge length of 1.94 inches (about 2.39 cm). All beams are pretreated with an alkaline cleaner.

Various sets of beams are then processed as follows:

- A first set of beams is anodized in a mixed electrolyte and produces a sulfate-phosphate oxide zone having a thickness of about 8 microns (the ME-8 μm beams). These beams are then coated with a polysilazane-based coating similar to that described in Example 6, above;
- A second set of beams is anodized in a mixed electrolyte and produces a sulfate-phosphate oxide zone having a thickness of about 12 microns (the ME-12 μm beams). These beams are then coated with a polysilazane-based coating similar to that described in Example 6, above;
- A third set of beams is anodized in a conventional Type II anodizing process and produces a sulfur oxide zone having a thickness of 9 microns (the Type II beams-1);
- A fourth set of beams is anodized in a conventional Type II anodizing process and produces a sulfur oxide zone having a thickness of 12 microns (the Type II beams-2);
- A fifth set of beams is anodized in a conventional Type II anodizing process and produces a sulfur oxide zone having a thickness of 8 microns. These beams are then sealed with an aqueous solution of sodium dichromate (NaDiCr beams).

Figure 10:
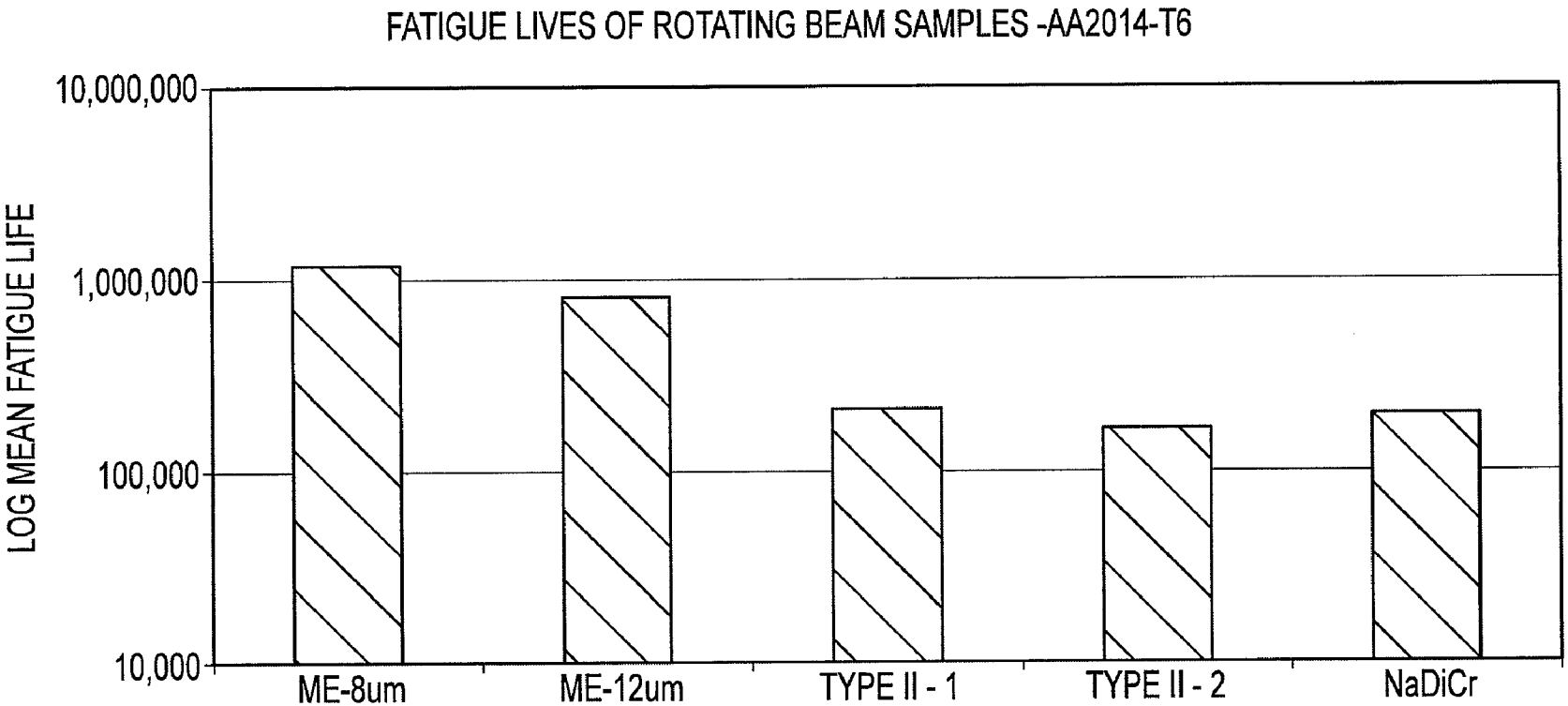
FIG. 10 is a graph illustrating the fatigue performance of various rotating beams.

The sets of beams are then subjected to exposure to a neutral pH salt solution (e.g., a 3.5 wt. % NaCl solution) in accordance with ASTM B117 for 336 hours—continuous spray, and then subjected to fatigue testing in accordance with ASTM E-466-96. The results of all fatigue tests are illustrated in FIG. 10.

The mixed electrolyte anodized and coated beams (i.e., the ME-8 μm and ME-12 μm beams) perform better than any of the Type II anodized beams. In particular, the log average fatigue life of the ME-8 μm beams is 1,180,753 cycles and the log average fatigue life of the ME-12 μm beams is 801,001 cycles. The log average fatigue life of the Type II beams-1 is 210,348 cycles and the log average fatigue life of the Type II beams-2 is 165,922 cycles. Thus, the mixed electrolyte beams realize a fatigue life that is better than the fatigue life of a Type-II anodized aluminum alloy product of similar composition, shape and temper and having a similar oxide thickness.

The mixed electrolyte anodized and coated beams (i.e., the ME-8 μm and ME-12 μm beams) also perform better than the NaDiCr beams. In particular, the log average fatigue life of the NaDiCr beams is 198,875 cycles. Thus, the mixed electrolyte beams realize a fatigue life that is better than the fatigue life of a Type-II anodized and sodium dichromate sealed aluminum alloy product of similar composition, shape and temper and having a similar oxide thickness. A chart detailing the fatigue life performance of the beams is provided in Table 1, below.

TABLE 1

| Sample | Fatigue Life (cycles to failure) |
|---|---|
| ME-8 μm | 1180753 |
| ME-12 μm | 801001 |
| Type II-1 | 210348 |
| Type II-2 | 165922 |
| NaDiCr | 198875 |

While various embodiments of the present application have been described in detail, it is apparent that modifications and adaptations of those embodiments will occur to those skilled in the art. However, it is to be expressly understood that such modifications and adaptations are within the spirit and scope of the present invention.

What is claimed is:

1. A wrought aluminum alloy product comprising:

(a) an aluminum alloy base;

(b) a porous sulfate-phosphate oxide zone integral with the base, the porous sulfate-phosphate oxide zone having:

(i) a plurality of pores, (ii) sulfur atoms, (iii) phosphorous atoms, (iv) wherein the porous sulfate-phosphate oxide zone has a ratio of the sulfur atoms (S) to the phosphorous atoms (P) of from about 5:1 (S:P) to about 100:1 (S:P), and (v) wherein the porous sulfate-phosphate oxide zone has an average thickness of at least about 8 microns; and (c) a silicon-containing polymer zone at least partially overlapping the porous sulfate-phosphate oxide zone, (i) wherein the silicon-containing polymer zone comprises silicon-containing polymer; and (ii) wherein the pores of the porous sulfate-phosphate oxide zone contain at least some of the silicon-containing polymer.

2. The product of claim 1, wherein the wrought aluminum alloy product is a forged aluminum alloy product.

3. The product of claim 2, wherein the forged aluminum alloy product is an aluminum alloy wheel product.

4. The product of claim 3, wherein the aluminum alloy wheel product comprises at least one of a 2XXX, a 6XXX and a 7xxx series aluminum alloy.

5. The product of claim 4, wherein the aluminum alloy wheel product has a cornering fatigue life that is better than the cornering fatigue life of a Type-II anodized aluminum alloy wheel product of similar composition, shape and temper and having a similar oxide thickness.

6. The product of claim 4, wherein the aluminum alloy wheel product has a radial fatigue life that is better than the radial fatigue life of a Type-II anodized aluminum alloy wheel product of similar composition, shape and temper and having a similar oxide thickness.

7. The product of claim 1, wherein the wrought aluminum alloy product is a sheet or plate product.

8. The product of claim 1, wherein the wrought aluminum alloy product is an extrusion product.

9. The product of claim 1, wherein the porous sulfate-phosphate oxide zone has an average thickness of at least about 12 microns.

10. The product of claim 1, wherein the silicon-containing polymer is polysilazane.

11. The product of claim 1, wherein the wrought aluminum alloy product has a fatigue life that is better than the fatigue life of a Type-II anodized and sodium dichromate sealed aluminum alloy product of similar composition, shape and temper and having a similar oxide thickness.

12. The product of claim 1, wherein the ratio of the sulfur atoms (S) to the phosphorous atoms (P) is at least about 10:1.

13. The product of claim 1, wherein the ratio of the sulfur atoms (S) to the phosphorous atoms (P) is at least about 20:1.

14. The product of any of claims 12 and 13, wherein the ratio of the sulfur atoms (S) to the phosphorous atoms (P) is not greater than about 75:1.

15. The product of claim 14, wherein the porous sulfate-phosphate oxide zone consists essentially of sulfur, phosphorous, oxygen and aluminum.

16. The product of claim 1 wherein the porous sulphate-phosphate oxide zone has an amorphous morphology.

* * * * *